US007398034B2

(12) United States Patent
Ito et al.

(10) Patent No.: US 7,398,034 B2
(45) Date of Patent: Jul. 8, 2008

(54) PROCESS CARTRIDGE FOR IMAGE-FORMING DEVICE

(75) Inventors: Yoshinori Ito, Toyokawa (JP); Takeyuki Takagi, Nagoya (JP); Soichiro Nishimura, Handa (JP); Nao Itabashi, Nagoya (JP); Tsutomu Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 221 days.

(21) Appl. No.: 11/411,798

(22) Filed: Apr. 27, 2006

(65) Prior Publication Data

US 2006/0245787 A1 Nov. 2, 2006

(30) Foreign Application Priority Data

Apr. 27, 2005 (JP) ..... 2005-130199
Apr. 28, 2005 (JP) ..... 2005-131350

(51) Int. Cl.
*G03G 21/16* (2006.01)

(52) U.S. Cl. ..... 399/111; 399/123

(58) Field of Classification Search ..... 399/107, 399/109, 111, 113, 114, 117, 119, 120, 123
See application file for complete search history.

(56) References Cited

U.S. PATENT DOCUMENTS 5,920,752 A * 7/1999 Karakama et al. ..... 399/111
5,937,237 A * 8/1999 Nonaka et al. ..... 399/106
6,041,203 A 3/2000 Suzuki et al.
6,219,504 B1 4/2001 Matsuzaki et al.
6,330,410 B1 12/2001 Okabe et al.
6,385,414 B1 5/2002 Sato et al.
6,411,789 B1 6/2002 Okabe et al.
6,546,217 B2 4/2003 Okabe et al.
6,690,903 B2 2/2004 Okabe et al.
6,714,749 B2 * 3/2004 Sato et al. ..... 399/102
6,873,810 B2 3/2005 Okabe et al.
6,983,114 B2 * 1/2006 Arimitsu ..... 399/114
2004/0190933 A1 9/2004 Murakami et al.
2005/0019056 A1 1/2005 Nishimura
2005/0135837 A1 6/2005 Okabe et al.

FOREIGN PATENT DOCUMENTS

EP 0389267 A2 9/1990

(Continued)

OTHER PUBLICATIONS

Partial EP Search Report Feb. 05, 2008, EP Appln. 06008669.1.

(Continued)

*Primary Examiner*—Hoan H Tran
(74) *Attorney, Agent, or Firm*—Banner & Witcoff, Ltd.

(57) ABSTRACT

A cartridge includes a cleaning unit. A casing having a wall that is formed with at least one opening that allows communication between an interior and an exterior of the casing. The cleaning unit is accommodated in the casing and that confronts the wall with a space being formed between the cleaning unit and the wall. At least a part of the cleaning unit confronts the at least one opening. The at least a part of the cleaning unit is in communication with the exterior of the casing via the at least one opening.

34 Claims, 14 Drawing Sheets

FOREIGN PATENT DOCUMENTS

| | | | |
|---|---|---|---|
| EP | 0527422 | A2 | 2/1993 |
| JP | 59-010979 | A | 1/1984 |
| JP | 10-239931 | | 9/1998 |
| JP | 11-184352 | | 7/1999 |
| JP | 11-242367 | A | 9/1999 |
| JP | 2000-98855 | | 4/2000 |
| JP | 2000-267371 | | 9/2000 |
| JP | 2000-267547 | | 9/2000 |
| JP | 2000-330457 | | 11/2000 |
| JP | 2001-13856 | | 1/2001 |
| JP | 2002-132121 | A | 5/2002 |
| JP | 2005-43801 | | 2/2005 |

OTHER PUBLICATIONS

Extended EP Search Report Mar. 25, 2008, EP Appln. 06008669.1.
CN Office Action dtd Mar. 28, 2008, CN App 200610079940X.

* cited by examiner

PROCESS CARTRIDGE FOR IMAGE-FORMING DEVICE

CROSS REFERENCE TO RELATED APPLICATIONS

This application claims priority from Japanese Patent Application No. 2005-130199 filed Apr. 27, 2005 and Japanese Patent Application No. 2005-131350 filed Apr. 28, 2005. The entire content of each of these priority applications is incorporated herein by reference.

TECHNICAL FIELD

The disclosure relates to an image-forming device, such as a laser printer, that forms images by developing electrostatic latent images with developer, and to a cartridge detachably mounted in the image-forming device.

BACKGROUND

One type of process cartridge employed in an image-forming device disclosed in U.S. Pat. No. 6,330,410 includes a drum cartridge accommodating a photosensitive drum, and a developer cartridge (toner cartridge) that is detachably mounted on the drum cartridge. The developer cartridge is provided with a developing roller for carrying toner on the surface thereof in order to develop electrostatic latent images formed on the photosensitive drum.

SUMMARY

In this type of image-forming device and process cartridge, the drum cartridge and developer cartridge must be accurately positioned relative to each other when the developer cartridge is mounted on the drum cartridge in order to form images at prescribed positions on a recording medium (paper) with no irregularities.

It is conceivable to position the drum cartridge and developer cartridge relative to each other by mounting the developer cartridge in a developer cartridge accommodating section provided in the drum cartridge, with the outer surfaces of the developer cartridge in the widthwise direction being in contact with the two inside surfaces of the developer cartridge accommodating section. However this conceivable positioning method may suffer from an accumulation of errors, including error in the outer dimensions of the drum cartridge (i.e., error in the dimensions of the two opposing internal surfaces in the developer cartridge accommodating section), error in the external dimensions of the developer cartridge, and error in the mounting positions of the photosensitive drum and developing roller in the respective cartridges. This accumulated error drastically reduces the precision in the relative positions of the photosensitive drum and the developing roller.

The dimensional tolerance for the developer cartridge accommodating section and the developer cartridge is relatively large because the dimensions between internal surfaces of the accommodating section and the dimensions between external surfaces of the developer cartridge are greater than the maximum size of paper that can be used in the image-forming device. Hence, if the clearance between the internal surfaces of the developer cartridge accommodating section and the external surfaces of the developer cartridge is relatively large, the developer cartridge has great play, that is, backlash, in the drum cartridge in the paper widthwise direction. However, lessening the clearance to reduce the amount of play could reduce the smoothness in which the developer cartridge is mounted in and removed from the developer cartridge accommodating section.

Another type of process cartridge disclosed in United States unexamined patent application publication No. 2005/0019056 is provided with a paper dust removal part for removing paper dust that becomes deposited on the surface of the photosensitive drum. This process cartridge includes a holder disposed on a frame of the process cartridge. The paper dust removal part is attached to the holder. The paper dust removal part includes a brush-shaped member that is supported on a plate.

The brush-shaped member contacts the surface of the photosensitive drum in the process cartridge. The plate supporting the brush-shaped member is attached to the holder on the frame. The back surface of the plate on the side opposite the surface supporting the brush-shaped member is blocked by the frame. In a high-temperature environment, heat accumulated inside the frame may raise the temperature of the plate, which can soften the toner deposited on the brush-shaped member and promote filming on the photosensitive drum.

Further, when the process cartridge having the structure described above is mounted in an image-forming device, the paper dust removal part is disposed between the photosensitive drum and the fixing unit. Accordingly, the plate of the paper dust removal part tends to rise in temperature by hot air from the fixing unit.

In view of the foregoing, it is an object of the invention to provide a process cartridge wherein a developer cartridge can be smoothly mounted in a drum cartridge with a reduced positional error.

It is another object of the invention to provide a process cartridge that has a simple configuration and that is capable of cooling a cleaning unit and capable of preventing filming on the image-carrying member due to the cleaning unit rising in temperature.

In order to attain the above and other objects, the invention provides a cartridge. The cartridge is for use in an image-forming device. The cartridge includes a casing, an image-bearing member, and a cleaning unit. The casing has a wall that is formed with at least one opening that allows communication between an interior and an exterior of the casing. The image-bearing member is accommodated in the casing and carries a developer image. The cleaning unit is accommodated in the casing and confronts the wall with a space being formed between the cleaning unit and the wall. At least a part of the cleaning unit confronts the at least one opening. The at least a part of the cleaning unit is in communication with the exterior of the casing via the at least one opening. The cleaning unit is configured to remove matter deposited on the image-bearing member.

According to another aspect, the invention provides an image-forming device. The image-forming device includes a main frame, a cartridge, a transfer unit, and a fixing unit. The cartridge is detachably mounted in the main frame. The cartridge includes a casing, an image-bearing member, and a cleaning unit. The casing has a wall that is formed with at least one opening that allows communication between an interior and an exterior of the casing. The image-bearing member is accommodated in the casing and carries a developer image. The cleaning unit is accommodated in the casing and confronts the wall with a space being formed between the cleaning unit and the wall. At least a part of the cleaning unit confronts the at least one opening. The at least a part of the cleaning unit is in communication with the exterior of the casing via the at least one opening. The cleaning unit is configured to remove matter deposited on the image-bearing member. The transfer unit is mounted in the main frame and transfers a developer image carried on the image-bearing member onto a recording medium. The fixing unit fixes the developer image to a recording medium.

According to another aspect, the invention provides an image-bearing cartridge. The image-bearing cartridge is for use in an image-forming device. The image-bearing cartridge includes a casing, an image-bearing member, and a cleaning unit. The casing has a wall that is formed with at least one opening that allows communication between an interior and an exterior of the casing. The image-bearing member is accommodated in the casing and carries a developer image. The cleaning unit is accommodated in the casing and confronts the wall with a space being formed between the cleaning unit and the wall. At least a part of the cleaning unit confronts at least a part of the at least one opening. The at least a part of the cleaning unit is in communication with the exterior of the casing via the at least one opening. The cleaning unit is configured to remove matter deposited on the image-bearing member.

According to another aspect, the invention provides a process cartridge. The process cartridge is for use in an image-forming device. The process cartridge includes a drum casing and a developer casing. The drum casing accommodates a photosensitive drum that carries a developer image. The photosensitive drum is formed in a cylindrical shape, and is rotatably supported around its rotational axis by the drum casing. The developer casing is detachably mounted on the drum casing. Either one of the drum casing and the developer casing has a rib that is formed in a plate-shape and that extends in a direction orthogonal to the rotational axis of the photosensitive drum. The other of the drum casing and the developer casing has a positioning unit engaging with the rib to position the drum casing and the developer casing relative to each other in the direction parallel to the rotational axis of the photosensitive drum.

According to another aspect, the invention provides an image-forming device. An image-forming device includes a main frame, a process cartridge and a developer casing. The process cartridge is detachably mounted in the main frame. The process cartridge includes a drum casing that accommodates an photosensitive drum. The photosensitive drum carries an electrostatic latent image thereon, is formed in a cylindrical shape, is rotatably supported around its rotational axis by the drum casing, and forms an electrostatic latent image thereon. The developer casing is detachably mounted on the drum casing and rotatably supports a developing roller parallel to the photosensitive drum and is in confrontation with the same. The developing roller is cylindrical in shape and is configured to carry a developer on a peripheral surface thereof to develop the electrostatic latent image into a developer image. The main frame and the drum casing includes a positioning mechanism that positions the drum-casing relative to the main frame in a direction parallel to the rotational axis of the photosensitive drum. Either one of the drum casing and the developer casing has a rib configured to position the drum casing and the developer casing relative to each other in a direction parallel to the rotational axis of the photosensitive drum. The other of the drum casing and the developer casing has an positioning unit that is configured to engage with the rib to position the drum casing and the developer casing relative to each other in a direction parallel to the rotational axis of the photosensitive drum.

BRIEF DESCRIPTION OF THE DRAWINGS

Illustrative aspects in accordance with the invention will be described in detail with reference to the following figures wherein:

FIGS. 8A and 8B, 9A and 9B, and 10A and 10B illustrate the procedure of assembling the cleaning member to the upper casing, wherein: FIG. 8A is a perspective view of an essential part in the upper casing and the cleaning member before the cleaning member is mounted on the upper casing, and FIG. 8B is a cross-sectional view of FIG. 8A; FIG. 9A is a perspective view of the essential part in the upper casing and the cleaning member when the cleaning member is being mounted on the upper casing, and FIG. 9B is a cross-sectional view of FIG. 9A; and FIG. 10A is a perspective view of the essential part in the upper casing and the cleaning member after the cleaning member is completely mounted on the upper casing, and FIG. 10B is a cross-sectional view of FIG. 10A;

DETAILED DESCRIPTION

Figure 1:
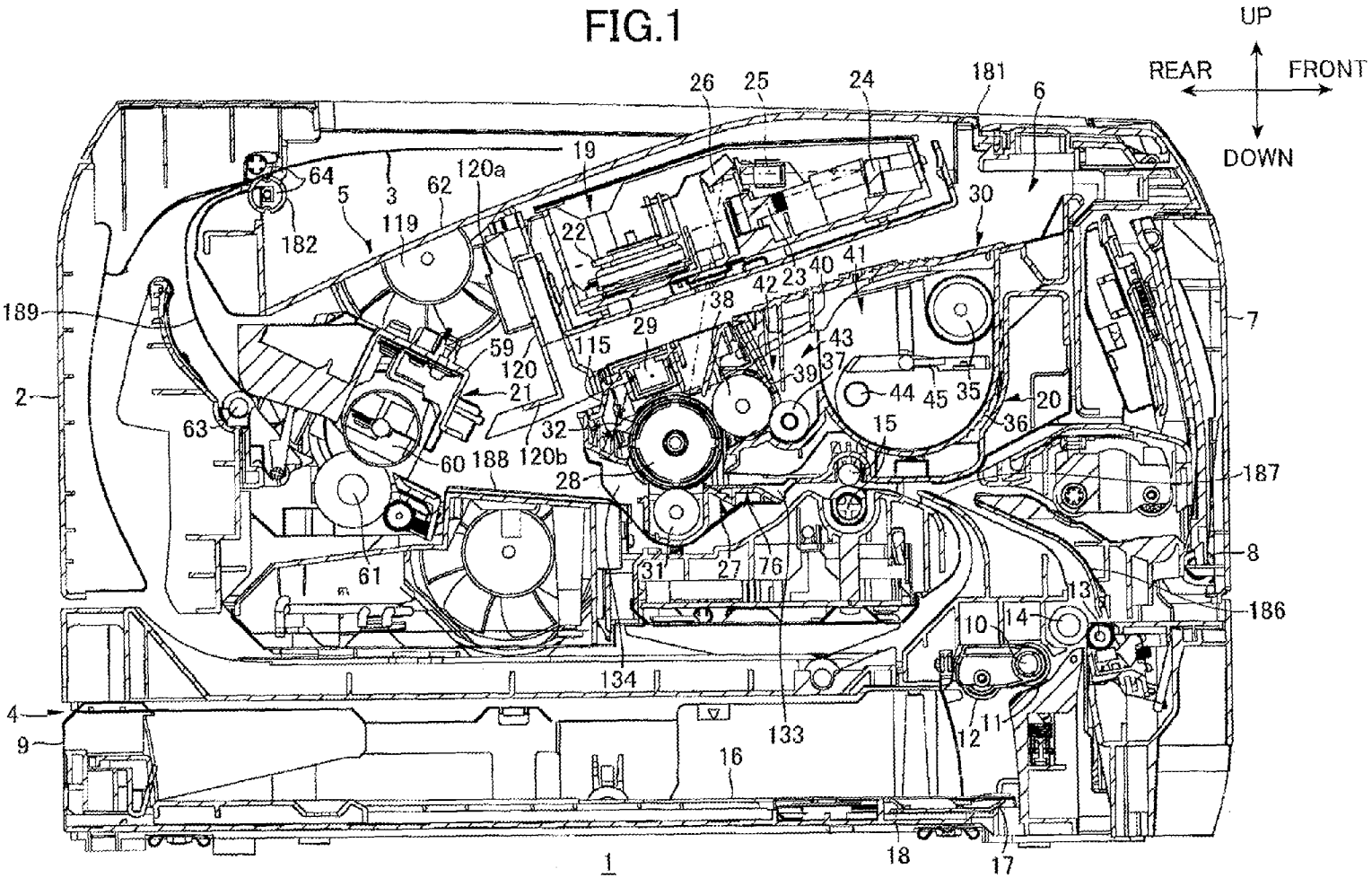
FIG. 1 is a side cross-sectional view of a laser printer according to an aspect of the invention.

A process cartridge for an image forming-device according to some aspects of the invention will be described while referring to the accompanying drawings wherein like parts and components are designated by the same reference numerals to avoid duplicating description.

1. General Structure of a Laser Printer

Figure 2:
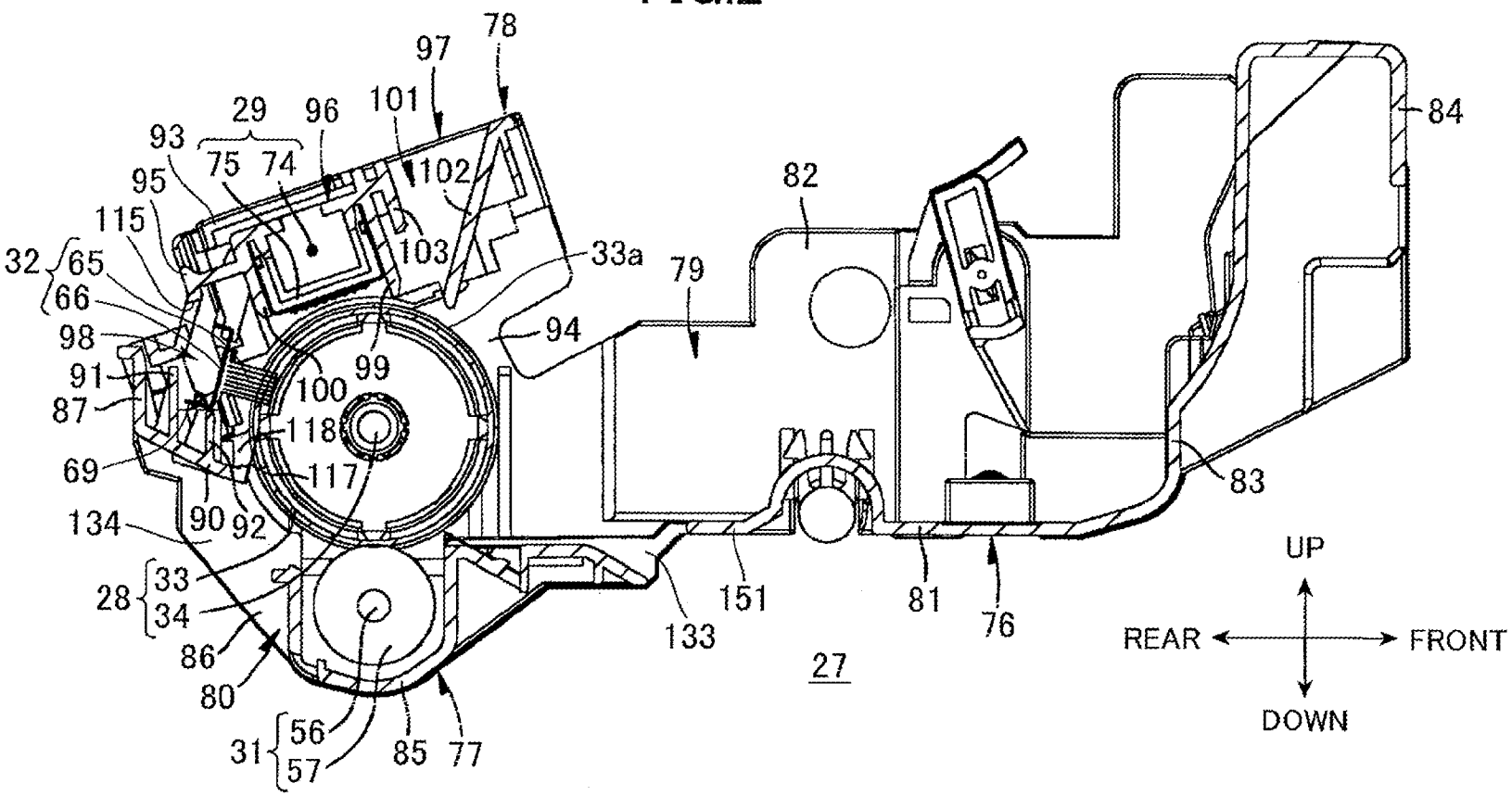
FIG. 2 is a side cross-sectional view of a drum cartridge employed in the laser printer of FIG. 1.

FIG. 1 is a side cross-sectional view of a laser printer 1 according to one aspect of the invention. FIG. 2 is a side cross-sectional view of a drum cartridge 27 employed in the laser printer 1 shown in FIG. 1.

As shown in FIG. 1, the laser printer 1 includes a main casing 2 and, within the main casing 2, a feeding unit 4 for supplying a sheet of paper 3, and an image-forming unit 5 for forming images on the paper 3 supplied by the feeding unit 4.

(1) Main Casing The main casing 2 is integrally formed of synthetic resin plates substantially formed in the shape of a rectangular parallelepiped. The main casing 2 serves to cover a main frame 200 (FIG. 15) that supports various components accommodated in the main casing 2. The main casing 2 includes a top surface 181, a discharge tray 62 formed on part of the top surface 181, and a discharge opening 182 formed in an upper portion of the main casing 2 above a lower section of the discharge tray 62. The discharge tray 62 slopes downward from a front side of the top surface 181 toward a rear side of the same, forming a depression in the top surface 181. The discharge tray 62 functions to receive paper discharged through the discharge opening 182.

The laser printer 1 also includes an access opening 6 formed in one side wall of the main casing 2 for inserting and removing a process cartridge 20 described later, and a front cover 7 capable of opening and closing over the access opening 6. The front cover 7 is rotatably supported by a cover shaft 8 inserted through a bottom edge of the front cover 7. Accordingly, when the front cover 7 is rotated closed about the cover shaft 8, the front cover 7 covers the access opening 6, as shown in FIG. 1. When the front cover 7 is rotated open about the cover shaft 8, the access opening 6 is exposed, enabling the process cartridge 20 to be mounted into or removed from the main casing 2 via the access opening 6.

The terms "upper", "lower", "right", "left", "front", "rear" and the like will be used throughout the description assuming that the laser printer 1 is disposed in an orientation in which it is intended to be used and that the process cartridge 20 is mounted in the laser printer 1. In use, the laser printer 1 is disposed and the process cartridge 20 is amounted in the laser printer 1 as shown in FIG. 1. Hence, the side of the laser printer 1 on which the front cover 7 is mounted and the corresponding side of the process cartridge 20 when the process cartridge 20 is mounted in the main casing 2 will be referred to as the "front side", while the opposite side will be referred to as the "rear side." The right-to-left direction will be referred to also as a "paper width direction". A vertical direction will be referred to also as a "height direction".

The main casing 2 is also provided with an exhausting fan 119 for exhausting air out of the main casing 2, and a duct 120 for guiding air to the exhausting fan 119.

The exhausting fan 119 is disposed above a fixing unit 21 described later. The duct 120 is arranged with the downstream end portion 120*a* in the direction that air flows through the duct 120 leading to the exhausting fan 119, and an upstream end portion 120*b* extending between the fixing unit 21 and the process cartridge 20 and, more specifically, leading from openings 115 described later that are formed in the process cartridge 20 to a region between the fixing unit 21 and the process cartridge 20.

(2) Feeding Unit

The feeding unit 4 includes a paper tray 9 that can be inserted into or removed from a lower section of the main casing 2 in the front-to-rear direction, a separating roller 10 and a separating pad 11 disposed above a front end of the paper tray 9, and a feeding roller 12 disposed on the rear side of the separating roller 10 upstream of the separating pad 11 with respect to the conveying direction of the paper 3 (hereinafter referred to as the "paper-conveying direction"). The feeding unit 4 also includes a paper dust roller 13 disposed above and forward of the separating roller 10 and downstream of the separating roller 10 in the paper-conveying direction, and a pinch roller 14 disposed in opposition to the paper dust roller 13.

A paper-conveying path for the paper 3 on the feeding end reverses directions toward the rear side of the laser printer 1, forming a substantial U-shape near the paper dust roller 13. The feeding unit 4 also includes a pair of registration rollers 15 disposed below the process cartridge 20 farther downstream of the U-shaped portion of the paper-conveying path with respect to the paper-conveying direction. An upstream guide 186 is disposed surrounding the pinch roller 14. The upstream guide 186 guides a paper 3 from the pinch roller 14 to be reversed toward the rear direction. A bottom guide 187 is disposed between the downstream end of the upstream guide 186 and the registration rollers 15. The bottom guide 187 supports a paper from below. The bottom guide 187 guides the paper from the pinch roller 14 toward the process cartridge 20.

A paper-pressing plate 16 is provided inside the paper tray 9 for supporting the sheets of paper 3 in a stacked state. The paper-pressing plate 16 is pivotably supported on the rear end thereof, so that the front end can pivot downward to a resting position in which the paper-pressing plate 16 rests on a bottom plate of the paper tray 9 and can pivot upward to a feeding position in which the paper-pressing plate 16 slopes upward from the rear end to the front end.

A lever 17 is provided in the front section of the paper tray 9 for lifting the front end of the paper-pressing plate 16 upward. The rear end of the lever 17 is pivotably supported on a lever shaft 18 at a position below the front end of the paper-pressing plate 16 so that the front end of the lever 17 can pivot between a level position in which the lever 17 lies along the bottom plate of the paper tray 9 and a sloped position in which the front end of the lever 17 lifts the paper-pressing plate 16 upward. When a driving force is inputted into the lever shaft 18, the lever 17 rotates about the lever shaft 18 and the front end of the lever 17 raises the front end of the paper-pressing plate 16, shifting the paper-pressing plate 16 into the feeding position.

When the paper-pressing plate 16 is in the feeding position, the topmost sheet of paper 3 stacked on the paper-pressing plate 16 is pressed against the feeding roller 12. The rotating feeding roller 12 begins feeding the sheet of paper 3 toward a separating position between the separating roller 10 and separating pad 11.

When the paper tray 9 is removed from the main casing 2, the paper-pressing plate 16 settles into the resting position. While the paper-pressing plate 16 is in the resting position, sheets of paper 3 can be stacked on the paper-pressing plate 16.

When the feeding roller 12 conveys a sheet of the paper 3 toward the separating position and the sheet becomes interposed between the separating roller 10 and separating pad 11, the rotating separating roller 10 separates and feeds the paper 3 one sheet at a time. Each sheet of paper 3 fed by the separating roller 10 passes between the paper dust roller 13 and pinch roller 14. After the paper dust roller 13 removes paper dust from the sheet of paper 3, the sheet is conveyed along the U-shaped paper-conveying path on the feeding end, thereby reversing directions, and is conveyed toward the registration rollers 15.

After registering the paper 3, the registration rollers 15 convey the paper 3 to a transfer position between a photosensitive drum 28 and a transfer roller 31 described later, at which position a toner image formed on the photosensitive drum 28 is transferred onto the paper 3.

(3) Image-forming Unit

The image-forming unit 5 includes a scanning unit 19, the process cartridge 20, and the fixing unit 21.

(a) Scanning Unit

The scanning unit 19 is disposed in a top section of the main casing 2 and includes a laser light source (not shown), a polygon mirror 22 that can be driven to rotate, an fθ lens 23, a reflecting mirror 24, a lens 25, and a reflecting mirror 26. The laser light source emits a laser beam based on image data. As illustrated by a dotted line in FIG. 1, the laser beam is deflected by the polygon mirror 22, passes through the fθ lens 23, is reflected by the reflecting mirror 24, passes through the lens 25, and is reflected downward by the reflecting mirror 26 to be irradiated on the surface of the photosensitive drum 28 in the process cartridge 20.

(b) Process Cartridge

As shown in FIG. 1, the process cartridge 20 is provided in the main casing 2 beneath the scanning unit 19 and can be mounted in or removed from the main casing 2 through the access opening 6.

Figure 3:
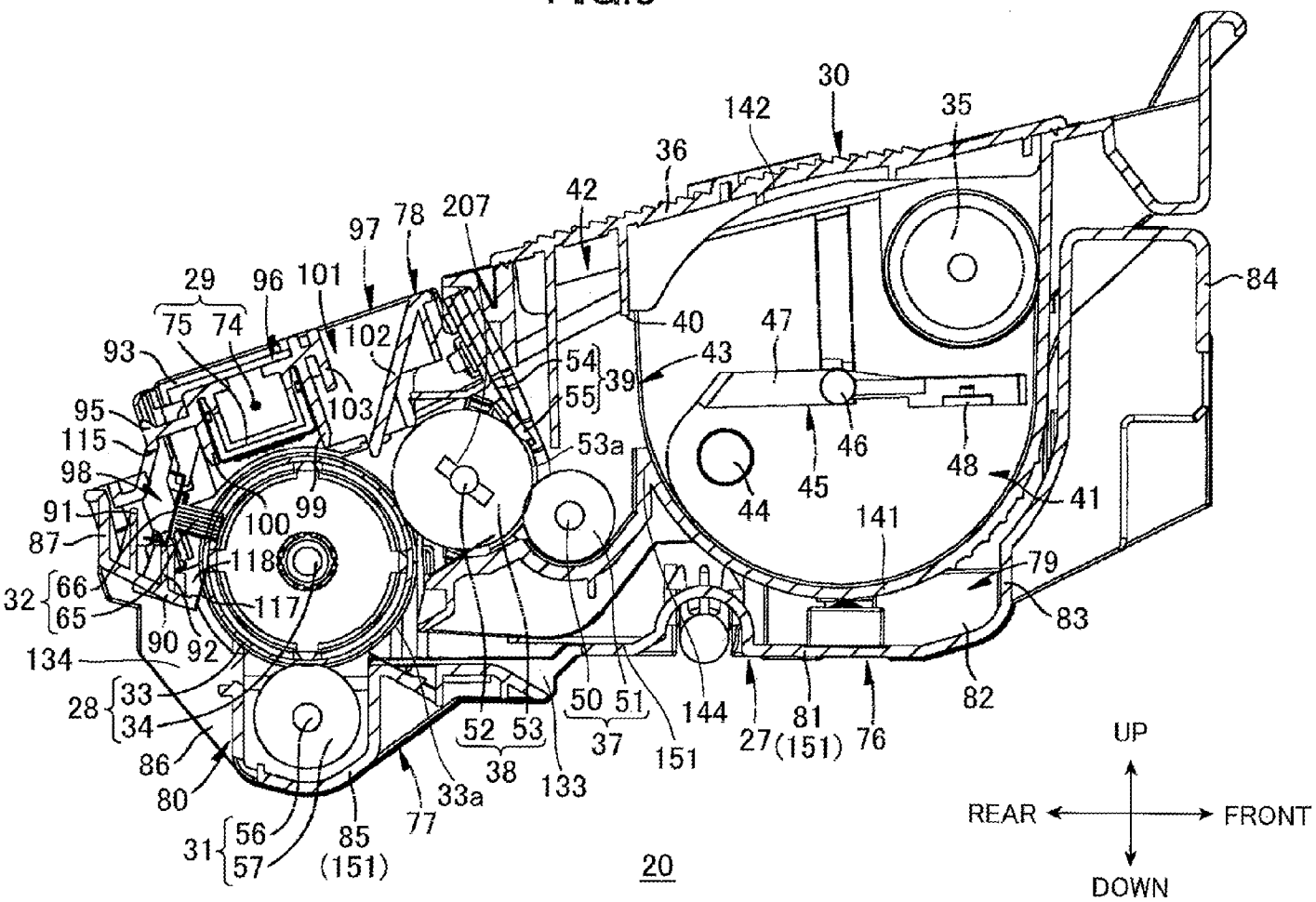
FIG. 3 is a side cross-sectional view of a process cartridge employed in the laser printer of FIG. 1.

As shown in FIG. 3, the process cartridge 20 includes a drum cartridge 27 and a developer cartridge 30 that is detachably mounted on the drum cartridge 27.

As shown in FIG. 2, the drum cartridge 27 includes a drum casing 76 described later in greater detail and, within the drum casing 76, the photosensitive drum 28, a Scorotron charger 29, the transfer roller 31, and a cleaning member 32.

The photosensitive drum 28 includes a main drum body 33 that is cylindrical in shape and has a positive charging photosensitive layer formed of polycarbonate or the like on a peripheral surface 33*a* of the main drum body 33, and a metal drum shaft 34 extending through the center of the main drum body 33 along the axial direction thereof. The metal drum shaft 34 is supported in the drum casing 76, and the main drum body 33 is rotatably supported relative to the metal drum shaft 34. With this construction, the photosensitive drum 28 is disposed in the drum casing 76 and is capable of rotating about the metal drum shaft 34. Further, the photosensitive drum 28 is driven to rotate by a driving force inputted from a motor (not shown). The axial direction of the drum shaft 34 is parallel to the paper width direction when the process cartridge 20 is mounted on the main casing 2.

The charger 29 is supported on the drum casing 76 diagonally above and rearward of the photosensitive drum 28. The charger 29 opposes the photosensitive drum 28 but is separated a prescribed distance from the photosensitive drum 28 so as not to contact the same. The charger 29 includes a discharge wire 74 disposed in opposition to but separated a prescribed distance from the photosensitive drum 28, and a grid 75 provided between the discharge wire 74 and the photosensitive drum 28 for controlling the amount of corona discharge from the discharge wire 35 that reaches the photosensitive drum 28. By applying a high voltage to the discharge wire 74 for generating a corona discharge from the discharge wire 74 at the same time a bias voltage is applied to the grid 75, the charger 29 can charge the surface of the photosensitive drum 28 with a uniform positive polarity.

The transfer roller 31 is disposed in the drum casing 76 below the photosensitive drum 28 and contacts the photosensitive drum 28 in a vertical direction from the bottom thereof so as to form a nip part with the photosensitive drum 28. The transfer roller 31 is configured of a metal roller shaft 56 that is covered with a roller 57 formed of an electrically conductive rubber material. The roller shaft 56 is rotatably supported in the drum casing 76. The transfer roller 31 is driven to rotate by a driving force inputted from a motor (not shown). Further, a transfer bias is applied to the transfer roller 31 during a transfer operation.

A paper inlet 133 is formed in the drum casing 76 upstream of the transfer roller 31 in the paper-conveying direction as an opening for guiding paper into the drum casing 76 to a transfer position between the photosensitive drum 28 and transfer roller 31. A paper outlet 134 is also formed in the drum casing 76 downstream of the transfer roller 31 in the paper-conveying direction as an opening through which the paper is discharged from the drum casing 76.

The cleaning member 32 is mounted on the drum casing 76 in a position confronting the photosensitive drum 28 from the rear side thereof. As will be described in greater detail later, the cleaning member 32 includes a cleaning brush 65 that captures paper dust deposited on the photosensitive drum 28, and a support plate 66 that supports the rear side of the cleaning brush 65 on the side opposite the photosensitive drum 28.

The cleaning brush 65 is configured of a nonwoven fabric implanted with a plurality of fibrous brush bristles having electrical conductivity, and is fixed to the support plate 66 by a double-sided tape. The cleaning brush 65 is disposed so as to confront and contact the photosensitive drum 28. It is also possible to affix only the nonwoven fabric to the support plate 66 that has no fibrous brush bristle and to place the support plate 66 in contact with the photosensitive drum 28, provided that the nonwoven fabric can capture paper dust.

While the support plate 66 is supported on the drum casing 76, an electrode plate 111 described later (see FIG. 8A) urges the support plate 66 from the side opposite the cleaning brush 65 in a direction toward the photosensitive drum 28. The electrode plate 111 also applies an electric bias to the support plate 66 during a cleaning operation.

As is described in greater detail below, a collecting unit 118 is provided on the drum casing 76 below the cleaning member 32 for collecting paper dust removed by the cleaning member 32.

As shown in FIG. 3, the developer cartridge 30 is detachably mounted on the drum casing 76. Accordingly, when the process cartridge 20 is already mounted in the main casing 2, the developer cartridge 30 can be detached from the main casing 2 by first opening the front cover 7 and subsequently removing the developer cartridge 30 from the drum cartridge 27 through the access opening 6 and mounting another developer cartridge 30 on the drum cartridge 27.

As shown in FIG. 3, the developer cartridge 30 includes a developer casing 36 and, within the developer casing 36, a supply roller 37, a developing roller 38, and a thickness-regulating blade 39.

Figure 13:
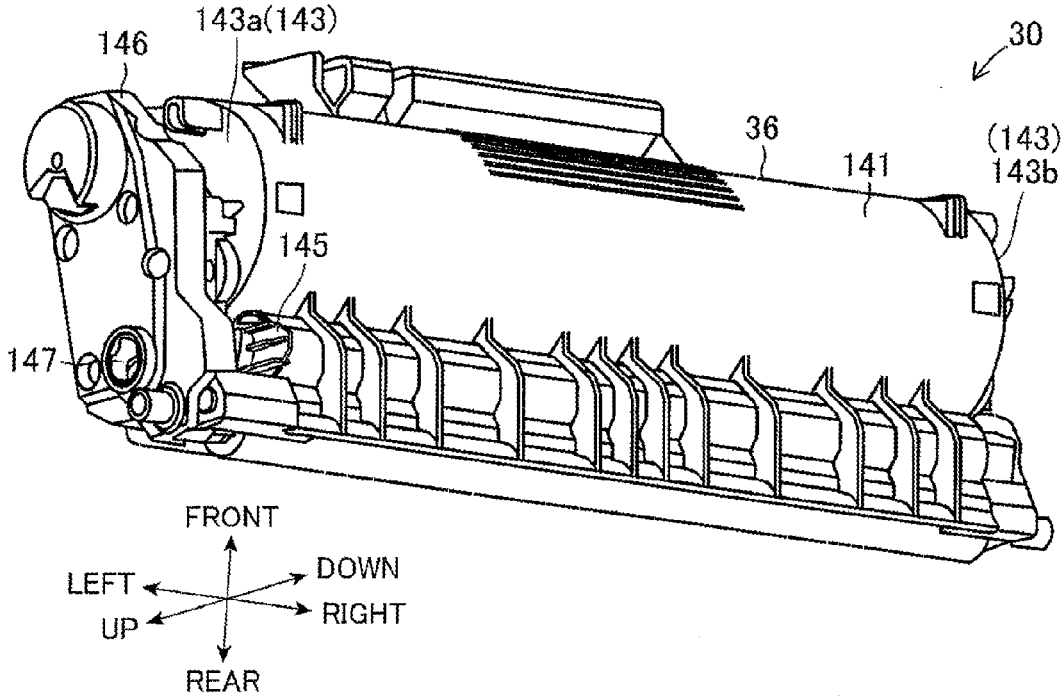
FIG. 13 is a perspective view from below showing the developer cartridge.

As shown in FIG. 13, the developer casing 36 is formed in a box shape that is open on the rear side. A partitioning wall 40 is provided in the developer casing 36 for partitioning the interior of the developer casing 36 into a toner-accommodating chamber 41 and a developing chamber 42.

(c) Developer Cartridge

The developer casing 36 includes a bottom wall 141, two side walls 143 (left side wall 143*a* and right side wall 143*b*) (FIG. 13), and a top wall 142. The side walls 143 of the developer casing 36 are joined to both widthwise edges of the bottom wall 141. The bottom wall 141 and side walls 143 are integrally formed of synthetic resin through injection molding.

The space encompassed by the bottom wall 141 and the pair of side walls 143 is open on the top edges and rear surface side of the bottom wall 141 and side walls 143. The top wall 142 covers the opening formed by the top edges of the side walls 143.

The partitioning wall 40 is disposed at a position in the developer casing 36 midway in the front-to-rear direction for partitioning the interior of the developer casing 36 in the front-to-rear direction. An opening 43 penetrates a midway region of the partitioning wall 40. A protruding wall 144 protrudes upward from the bottom wall 141. The protruding wall 144 is disposed between an agitator 45 and the supply roller 37.

The toner-accommodating chamber 41 occupies a space in the front side of the casing 36 partitioned by the partitioning wall 40. The toner-accommodating chamber 41 is filled with a nonmagnetic, single-component toner having a positive charging nature. The toner used in this example is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity for achieving high-quality image formation.

This type of toner is compounded with a coloring agent, such as carbon black, or wax, as well as an additive such as silica to improve fluidity. The average diameter of the toner particles is about 6-10 μm.

Toner supply openings for filling the toner-accommodating chamber 41 with toner are formed in both side walls 143 of the developer casing 36 that define the toner-accommodating chamber 41. The toner supply openings are sealed with caps 35.

Toner detection windows 44 are provided in both side walls 143 of the casing 36 that define the toner-accommodating chamber 41 for detecting the amount of toner remaining in the toner-accommodating chamber 41. The toner detection windows 44 are formed in the side walls 143 near the partitioning wall 40 and oppose each other in the width direction (the direction orthogonal to the front-to-rear direction and the vertical) across the toner-accommodating chamber 41. The toner detection windows 44 are formed by embedding a transparent disc-shaped plate in each side wall 143.

The agitator 45 is disposed in the toner-accommodating chamber 41 for agitating toner accommodated therein. The agitator 45 includes a rotational shaft 46 and an agitating member 47.

The rotational shaft 46 is rotatably supported in the side walls 143 substantially in the center of the toner-accommodating chamber 41. The agitating member 47 is provided on the rotational shaft 46. A motor (not shown) produces a driving force that is inputted into the rotational shaft 46 for driving the rotational shaft 46 to rotate. Consequently, the agitating member 47 moves in a circular path about the rotational shaft 46 through the toner-accommodating chamber 41 and stirs toner accommodated in the toner-accommodating chamber 41. When the agitating member 47 stirs the toner, some of the toner is discharged in the front-to-rear direction toward the supply roller 37 through the opening 43 formed in the partitioning plate 40.

The agitator 45 also includes wipers 48 attached at both axial ends of the rotational shaft 46. When the rotational shaft 46 rotates, the wipers 48 move in a circular direction about the rotational shaft 46 through the toner-accommodating chamber 41 in order to wipe the toner detection windows 44 provided in the side walls 143. Hence, the wipers 48 function to clean the toner detection windows 44.

The developing chamber 42 occupies an interior space in the rear side of the casing 36 partitioned by the partitioning wall 40 and the protruding wall 144. The developing chamber 42 accommodates the supply roller 37, the developing roller 38, and the thickness-regulating blade 39.

The supply roller 37 is disposed rearward of the opening 43 in the developing chamber 42 and includes a metal roller shaft 50 covered by a sponge roller 51 formed of an electrically conductive foam material. The roller shaft 50 is rotatably supported within the developing chamber 42 in both side walls 143 of the casing 36. The supply roller 37 is driven to rotate by a driving force inputted into the roller shaft 50 from a motor (not shown).

During an image-forming process, the supply roller 37 is driven to rotate counterclockwise in FIG. 1 for supplying a charged toner to the peripheral surface of the developing roller 38.

The developing roller 38 is disposed rearward of the supply roller 37 and contacts the supply roller 37 with pressure so that both are compressed. The developing roller 38 includes a metal roller shaft 52, and a rubber roller 53 formed of an electrically conductive rubber material that covers the roller shaft 52. The rubber roller 53 has a peripheral surface 53*a* (FIG. 3). The roller shaft 52 is rotatably supported in the pair of the side walls 143 within the developing chamber 42. The rubber roller 53 is more specifically formed of an electrically conductive urethane rubber or silicone rubber containing fine carbon particles, the surface of which is coated with urethane rubber or silicone rubber containing fluorine. The developing roller 38 is driven to rotate by a driving force inputted into the roller shaft 52 from a motor (not shown). Further, a developing bias is applied to the developing roller 38 during a developing operation.

When the developer cartridge 30 is mounted on the drum casing 76, the developing roller 38 becomes parallel to the photosensitive drum 28 and the peripheral surface 53*a* of the developing roller 38 exposed from the developer casing 36 opposes the photosensitive drum 28 and contacts the peripheral surface 33*a* of the photosensitive drum 28 via a thin layer of toner carried on the peripheral surface 53*a* of the developing roller 38.

The thickness-regulating blade 39 includes a main blade member 54 configured of a metal leaf spring, and a pressing part 55 provided on a distal end of the main blade member 54. The pressing part 55 has a semicircular cross section and is formed of an insulating silicone rubber. A base end of the main blade member 54 is supported on the developer casing 36 above the developing roller 38, and the pressing part 55 contacts the developing roller 38 with pressure through the elastic force of the main blade member 54.

Toner discharged through the opening 43 is supplied onto the developing roller 38 by the rotating supply roller 37. At this time, the toner is positively tribocharged between the supply roller 37 and the developing roller 38. As the developing roller 38 rotates, the toner supplied to the surface of the developing roller 38 passes between the rubber roller 53 of the developing roller 38 and the pressing part 55 of the thickness-regulating blade 39, thereby forming a layer of toner on the surface of the developing roller 38. The thickness-regulating blade 39 regulates the thickness and the charging amount of the toner held on the developing roller 38.

As the photosensitive drum 28 rotates, the charger 29 charges the surface of the photosensitive drum 28 with a uniform positive polarity. Subsequently, a laser beam emitted from the scanning unit 19 is scanned at a high speed over the surface of the photosensitive drum 28, forming an electrostatic latent image corresponding to an image to be formed on the paper 3.

Next, positively charged toner carried on the surface of the developing roller 38 comes into contact with the photosensitive drum 28 as the developing roller 38 rotates and is supplied to areas on the surface of the positively charged photosensitive drum 28 that have been exposed to the laser beam and, therefore, have a lower potential. In this way, the latent image on the photosensitive drum 28 is transformed into a visible image according to a reverse developing process so that a toner image is carried on the surface of the photosensitive drum 28.

Figure 15:
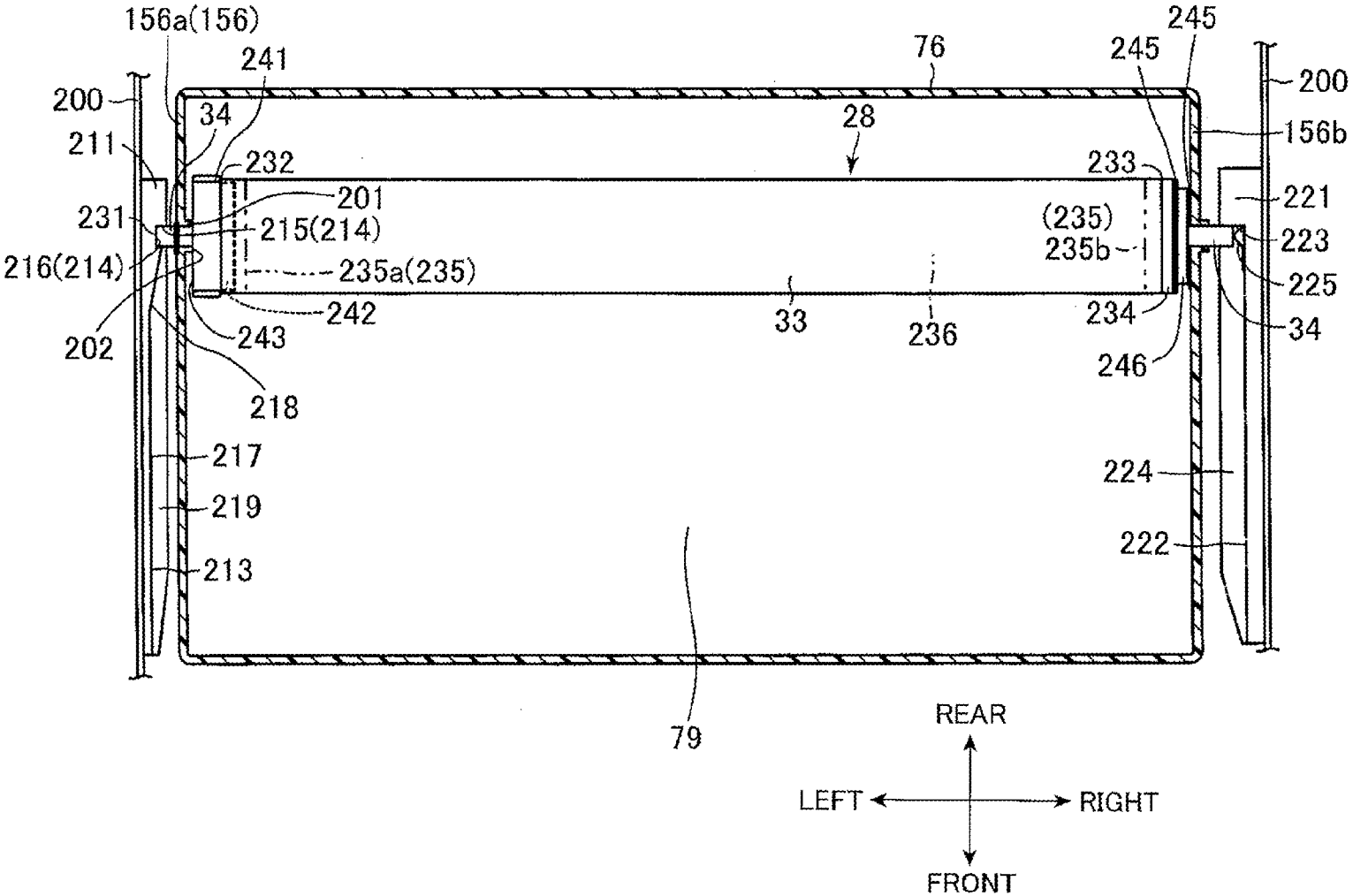
FIG. 15 is a horizontal cross-sectional view of the process cartridge mounted in a main frame of the laser printer in FIG. 1.

It is noted that as shown in FIG. 15, an effective latent image forming region 236 is defined as a region, on the peripheral surface 33*a*, where the photosensitive layer is properly formed and therefore electrostatic latent images can be properly formed. The effective latent image forming region 236 has a pair of effective region boundaries 235 (a left-end effective region boundary 235*a* and a right-end effective region boundary 235*b*) on its opposite ends in the paper width direction. The effective region boundaries 235 are located on the opposite end regions of the photosensitive drum 28 in the paper width direction.

The length of the peripheral surface 53*a* of the rubber roller 53 in the paper width direction that is sufficiently greater than the length of the effective latent image forming region 236 of the photosensitive drum 28 in the paper width direction. An effective image forming region is defined on the peripheral surface 53*a* of the rubber roller 53 as a region on which the toner is effectively supplied by the thickness-regulating blade 39 to have a prescribed thickness and a prescribed charging amount. The length of the effective image forming region in the paper width direction is greater than the length of the effective latent image forming region 236 in the paper width direction by a few length (several millimeters, in this example). It is noted, however, that the length of the effective image forming region in the paper width direction may be equal to the length of the effective latent image forming region 236 in the paper width direction.

Subsequently, as the registration rollers 15 convey a sheet of paper 3 into the drum casing 76 and through the transfer position between the photosensitive drum 28 and transfer roller 31, the toner image carried on the surface of the photosensitive drum 28 is transferred onto the paper 3 by the transfer bias applied to the transfer roller 31. The paper 3 on which the toner is transferred is conveyed to the fixing unit 21.

Toner remaining on the surface of the photosensitive drum 28 after a transfer has been made is recovered by the developing roller 38. Further, the cleaning brush 65 of the cleaning member 32 physically scrapes off paper dust that has been deposited from the paper 3 onto the surface of the photosensitive drum 28. In addition, the electrode plate 111 (FIG. 8A) applies the support plate 66 to a bias for electrically attracting the paper dust from the surface of the photosensitive drum 28. Paper dust removed by the cleaning member 32 is collected in the collecting unit 118 disposed below the cleaning member 32.

As shown in FIG. 1, a middle stream guide 188 is disposed between the paper outlet 134 of the drum casing 76 and the fixing unit 21. The middle stream guide 188 supports a paper 3 from below. The paper 3 is conveyed from the process cartridge 20 toward the fixing unit 21 while being guided by the middle stream guide 188.

(d) Fixing Unit

As shown in FIG. 1, when the process cartridge 20 is mounted in the main casing 2, the fixing unit 21 is disposed on the rear side of the process cartridge 20 and is separated from the photosensitive drum 28 of the process cartridge 20 in a substantially horizontal direction. The fixing unit 21 includes a fixing frame 59; and a heating roller 60 and a pressure roller 61 provided within the fixing frame 59.

The heating roller 60 includes a metal tube, the surface of which is coated with a fluorine resin, and a halogen lamp disposed inside the metal tube for heating the same. The heating roller 60 is driven to rotate by a driving force inputted from a motor (not shown).

The pressure roller 61 is disposed below and in opposition to the heating roller 60 and contacts the heating roller 60 with pressure. The pressure roller 61 is configured of a metal roller shaft covered with a roller that is formed of a rubber material. The pressure roller 61 follows the rotational drive of the heating roller 60.

In the fixing unit 21, a toner image transferred onto the paper 3 at the transfer position is fixed to the paper 3 by heat as the paper 3 passes between the heating roller 60 and pressure roller 61. After the toner image is fixed to the paper 3, the heating roller 60 and pressure roller 61 continue to convey the paper 3 along a discharge end paper-conveying path toward the discharge tray 62 formed on the top surface of the main casing 2.

The paper-conveying path on the discharge end leads from the fixing unit 21 to the discharge tray 62 and is substantially U-shaped for reversing the conveying direction of the paper 3 to a direction toward the front of the laser printer 1. A conveying roller 63 is disposed at a midpoint along the discharge end paper-conveying path, and a pair of discharge rollers 64 is disposed at a downstream end of the same path.

Hence, after passing through the fixing unit 21, the paper 3 is conveyed along the discharge end paper-conveying path as being guided by a downstream guide 189, where the conveying roller 63 receives and conveys the paper 3 to the discharge rollers 64, and the discharge rollers 64 subsequently receive and discharge the paper 3 onto the discharge tray 62.

Hot air generated from the heating roller 60 of the fixing unit 21 radiates and flows toward the photosensitive drum 28 of the process cartridge 20. However, since the upstream end 120*b* of the duct 120 is positioned between the fixing unit 21 and the process cartridge 20, the duct 120 guides the hot air to the exhausting fan 119, and the exhausting fan 119 exhausts the air out of the main casing 2.

2. Drum Casing and Cleaning Member

Figure 4:
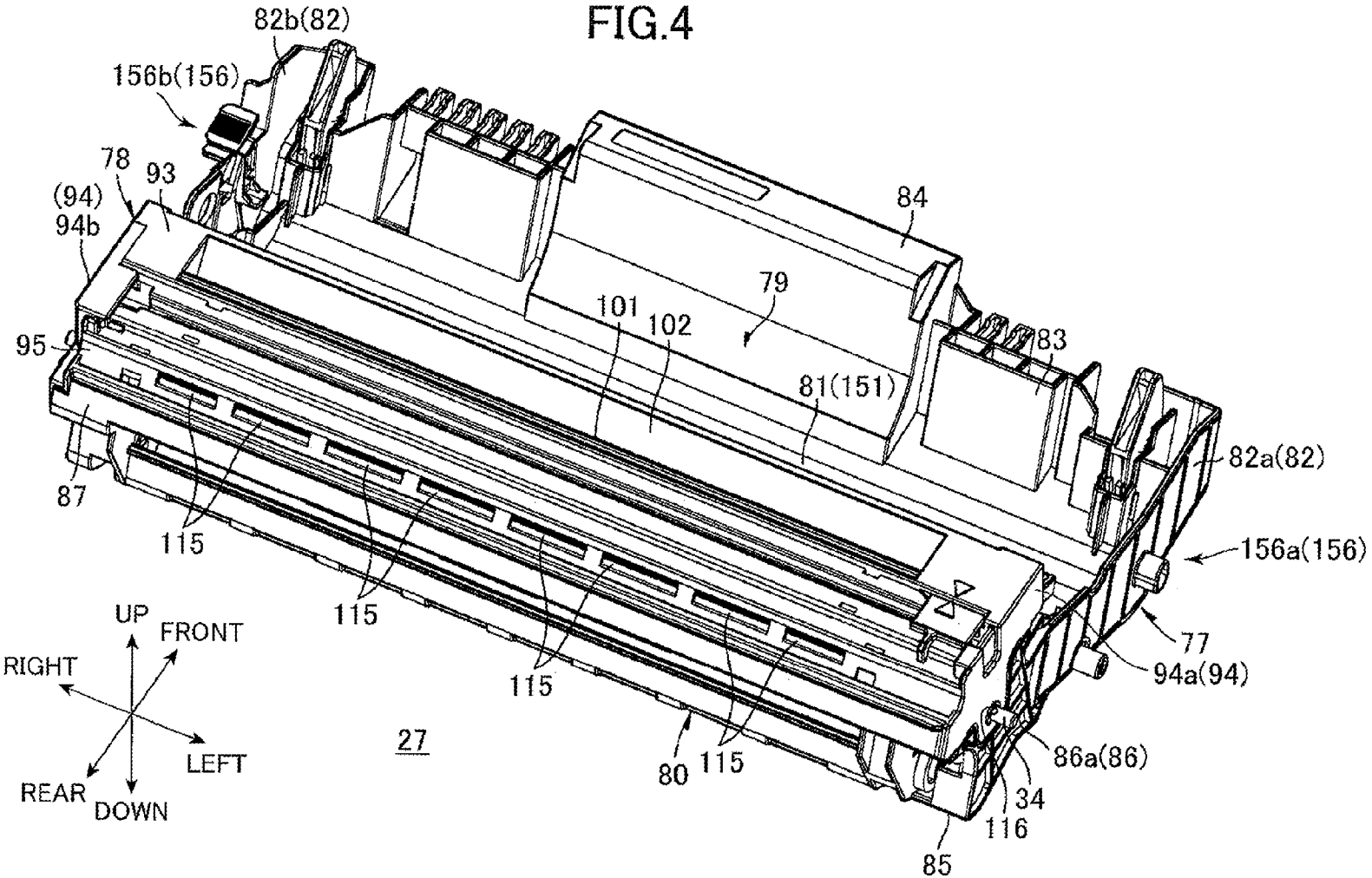
FIG. 4 is a perspective view from above the rear side of the drum cartridge.
Figure 5:
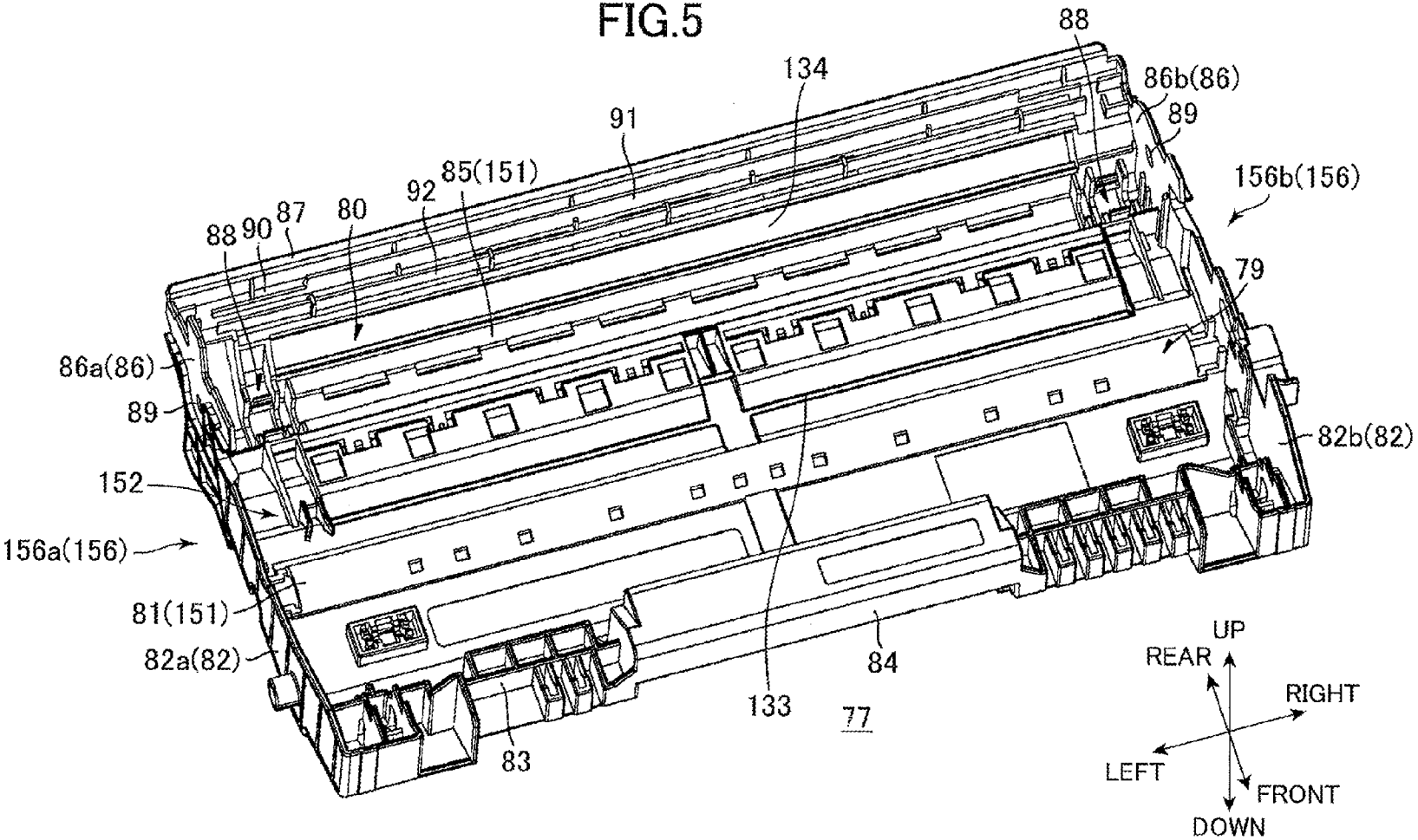
FIG. 5 is a perspective view from above the front side of a lower casing of the drum cartridge.
Figure 6:
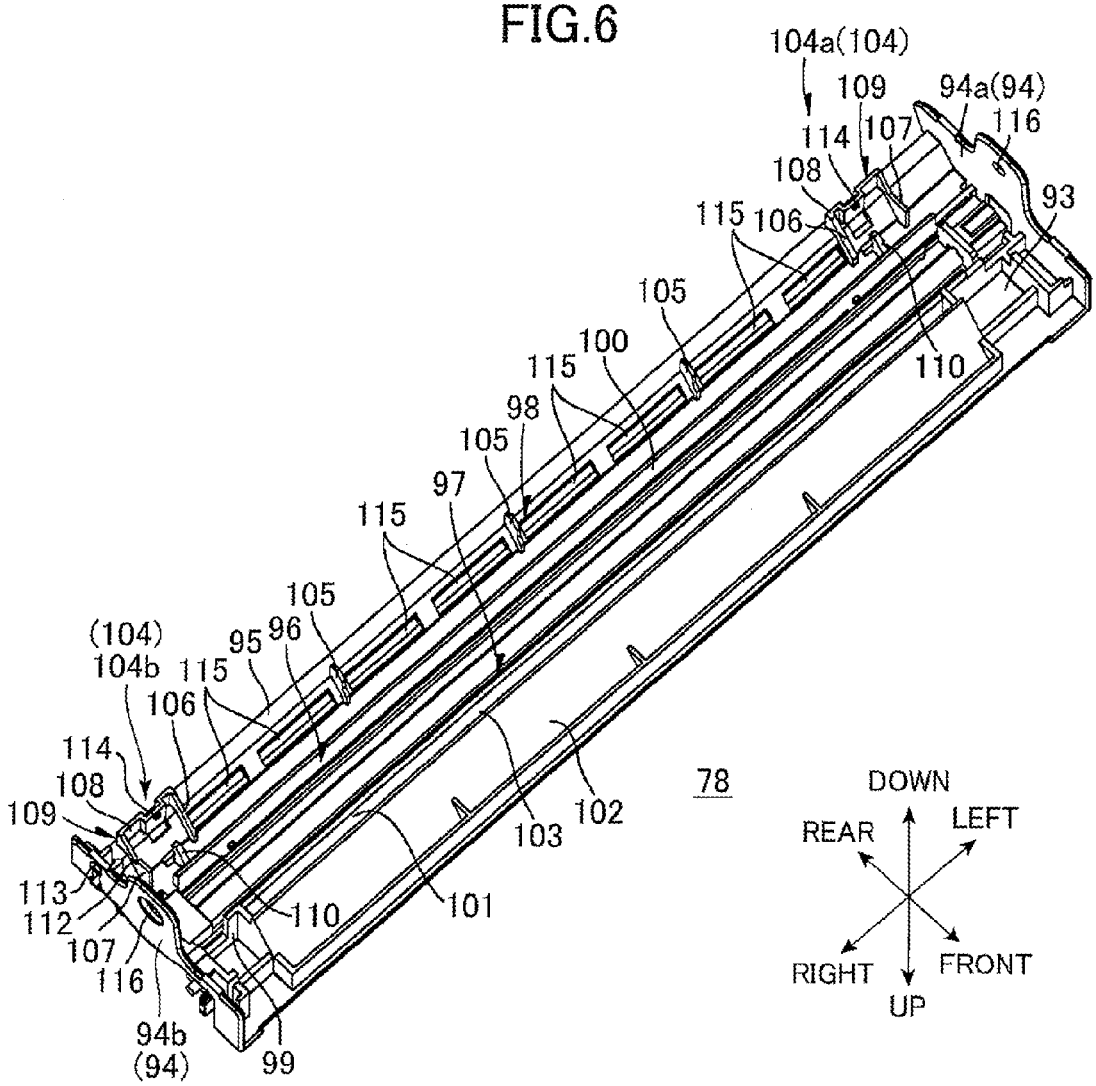
FIG. 6 is a perspective view from below the front side of an upper casing of the drum cartridge (before a cleaning member is attached)
Figure 7:
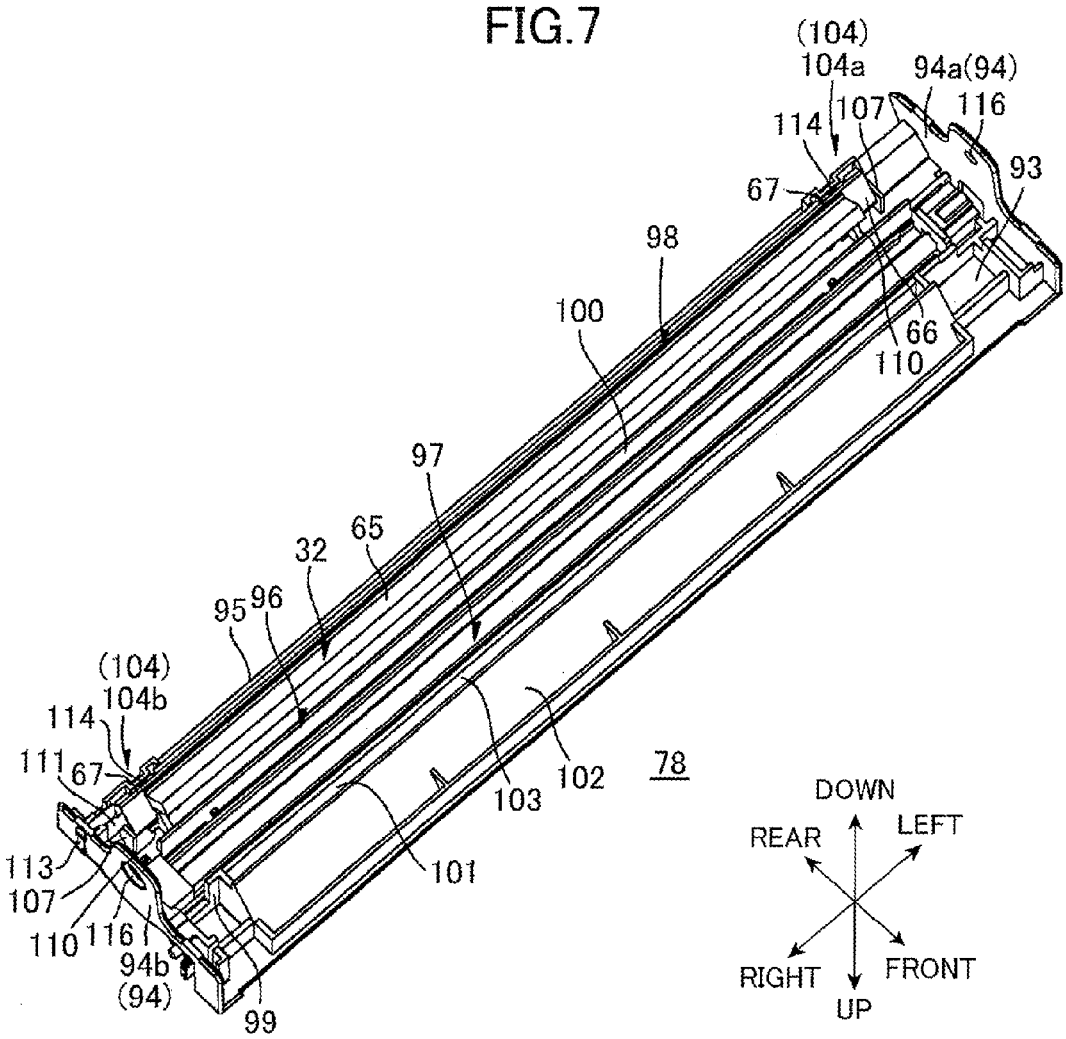
FIG. 7 is a perspective view from below the front side of the upper casing of the drum cartridge (after the cleaning member has been attached)
Figure 10A:
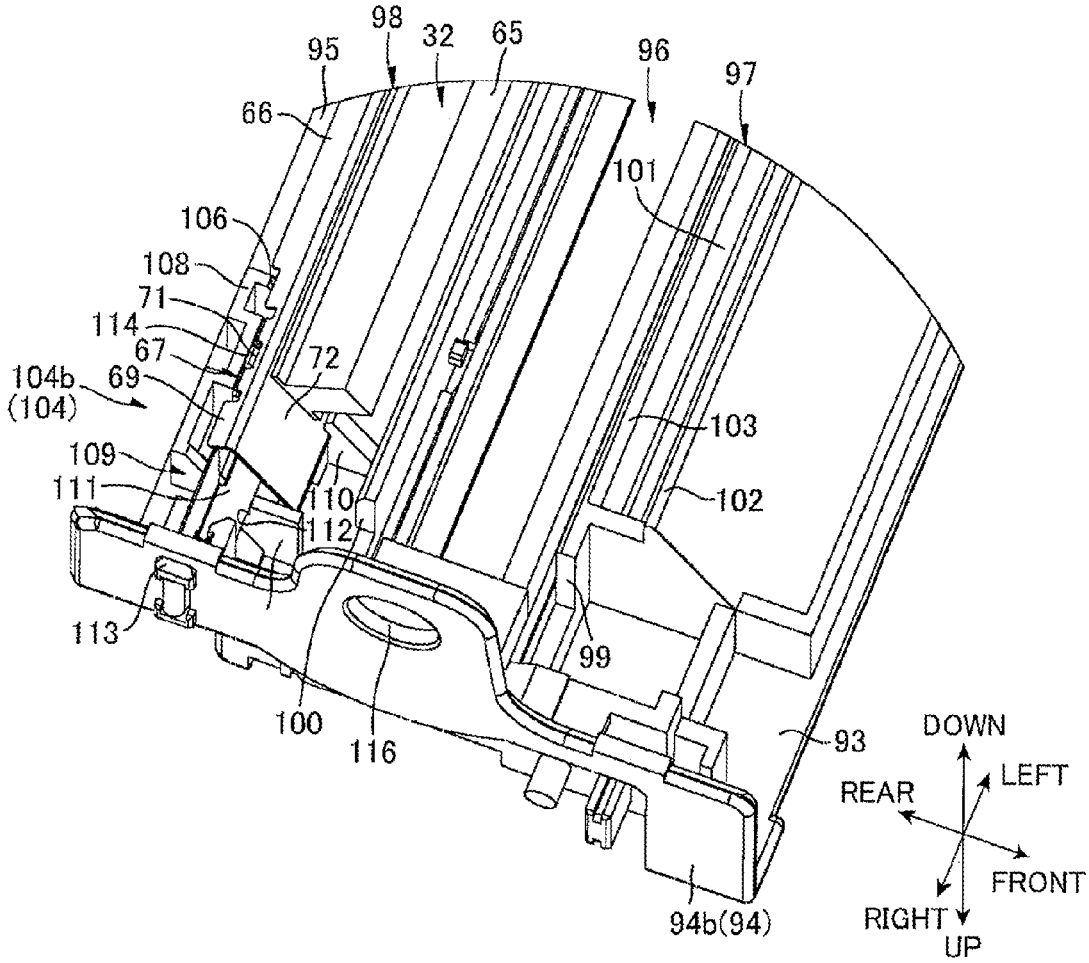
Figure 10B:
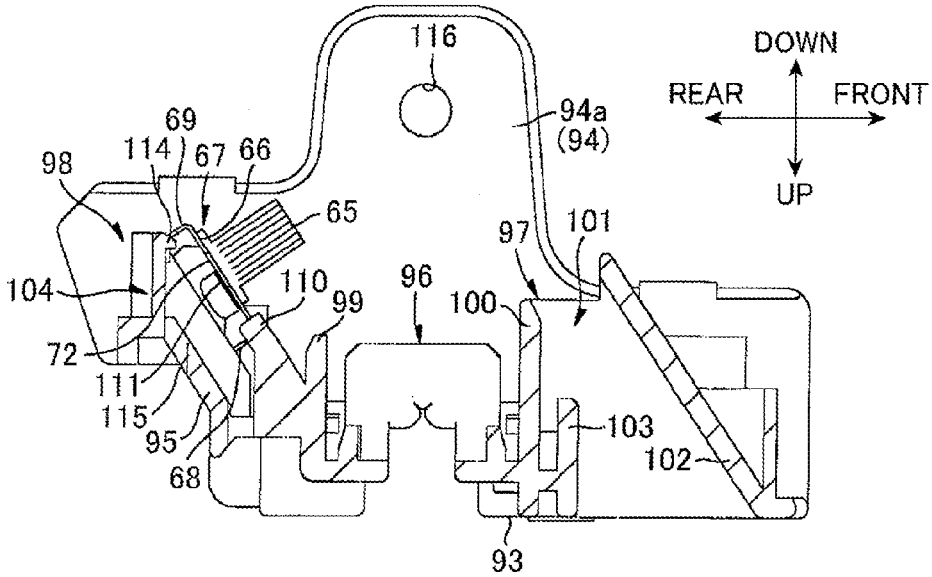
Figure 11A:
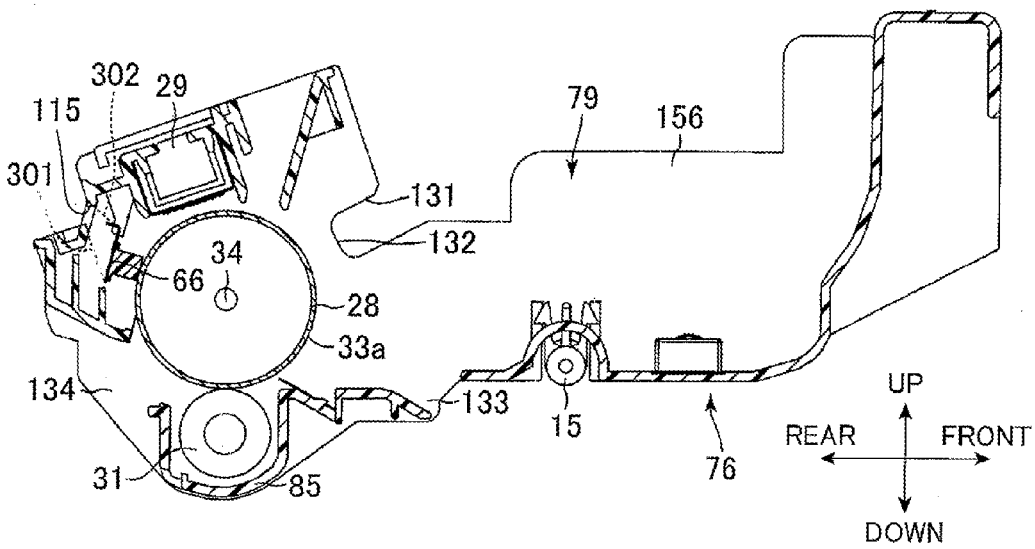
FIG. 11A is a side cross-sectional view of the drum cartridge illustrating the positional relationship between the cleaning member and the openings and illustrating the positional relationship between a positioning recess and a developing roller.
Figure 11B:
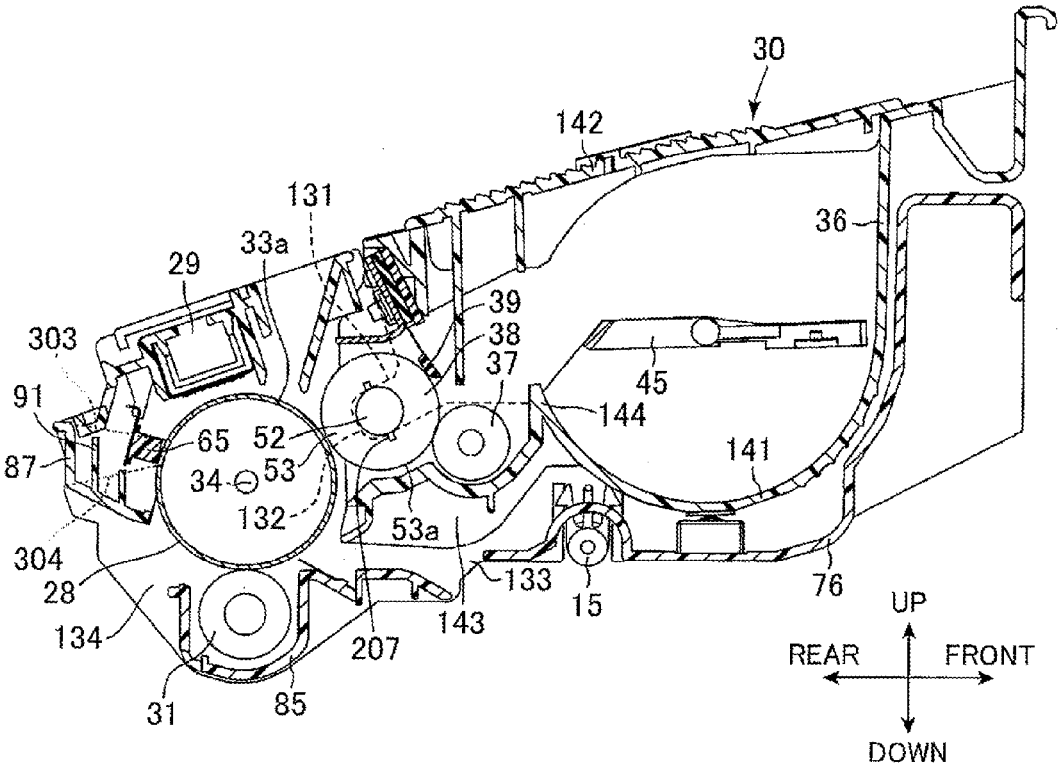
FIG. 11B is a side cross-sectional view illustrating the positional relationship between an inner rear wall and the cleaning member and illustrating the state how the photosensitive drum is positioned relative to the developing roller when the developer cartridge is mounted in the drum cartridge.

FIG. 4 is a perspective view from above the rear side of the drum cartridge 27. FIG. 5 is a perspective view from above the front side of a lower casing 77 of the drum cartridge 27. FIG. 6 is a perspective view from below the front side of an upper casing 78 of the drum cartridge 27 before the cleaning member 32 is attached. FIG. 7 is a perspective view from below the front side of the upper casing 78 of the drum cartridge 27 after the cleaning member 32 has been attached. FIGS. 8A through 10B illustrate steps in assembling the cleaning member 32 on the upper casing 78. FIGS. 11A and 11B illustrate the positional relationships among the cleaning member 32, the openings 115, and an inner rear wall 91 (to be described later).

Next, the drum casing 76 of the drum cartridge 27 and the cleaning member 32 mounted on the drum casing 76 will be described in detail with reference to FIGS. 1 through 11B.

(1) Structure of the Drum Casing

As shown in FIGS. 2 and 4, the drum casing 76 includes a lower casing 77, and an upper casing 78 formed separately from the lower casing 77 and assembled on top of the same.

(a) Lower Casing

As shown in FIG. 5, the lower casing 77 is integrally provided with a developer cartridge mounting unit 79 disposed on the front side thereof for receiving the developer cartridge 30, and a drum support unit 80 disposed on the rear side thereof and positioned to vertically confront the upper casing 78.

As shown in FIGS. 2 and 5, the developer cartridge mounting unit 79 is integrally provided with a front bottom wall 81 having substantially a rectangular plate shape for receiving the developer cartridge 30, two front side walls 82 (a front left side wall 82*a* and a front right side wall 82*b*) disposed at each widthwise end of the front bottom wall 81 and opposing each other across the width of the front bottom wall 81, and a lower front wall 83 disposed on the front end of the front bottom wall 81. The developer cartridge mounting unit 79 is formed in a frame shape having a bottom and an open top. As shown in FIG. 4, a handle 84 is formed in a widthwise center region of the lower front wall 83 for gripping the drum cartridge 27 when mounting or removing the same.

As shown in FIGS. 2 and 5, the drum support unit 80 is integrally provided with a rear bottom wall 85 having a curved shape on the bottom thereof for receiving the transfer roller 31, two rear side walls 86 (a rear left-side wall 86*a* and a rear right-side wall 86*b*) disposed on widthwise ends of the rear bottom wall 85 and opposing each other across the width of the rear bottom wall 85, and a lower rear wall 87 disposed on the rear edge of the rear bottom wall 85 and functioning as a heat shield.

The front end of the rear bottom wall 85 is formed continuously with the rear edge of the front bottom wall 81. Thus, the front bottom wall 81 and the rear bottom wall 85 are integrated together into a bottom wall 151 of the lower casing 77. As shown in FIG. 2, the rear bottom wall 85 is shaped sagging downward in the center from the front edge to the rear edge so as to be substantially fan-shaped in a side view. Transfer roller receiving parts 88 are formed in both widthwise ends of the rear bottom wall 85 for receiving the transfer roller 31.

As shown in FIGS. 2 and 5, the paper inlet 133 is formed in the bottom wall 151 at a location where the front bottom wall 81 is connected to the rear bottom wall 85. The paper inlet 133 is located in the central region of the bottom wall 151 in the paper width direction and is elongated in the width direction. An engaging unit 152 (which will be described later) is provided on the left side of the left-side edge of the paper inlet 133.

Two rear side walls 86 are bent to be erected vertically from the widthwise edges of the rear bottom wall 85. Through-holes 89 are formed in the rear side walls 86 at positions opposing each other in the width direction for inserting the drum shaft 34 of the photosensitive drum 28.

The rear left side wall 86*a* and the front left side wall 82*a* constitute together a left side wall 156*a* of the drum casing 76. The rear right side wall 86*b* and a front right side wall 82*b* constitute together a left side wall 156*b* of the drum casing 76. The left side wall 156*a* and the left side wall 156*b* will be collectively referred to as "side walls 156" hereinafter.

The lower rear wall 87 is formed continuously from the rear edge of the rear bottom wall 85 across the entire width between the rear side walls 86. The lower rear wall 87 is an elongated rectangular plate in a front view that is erected vertically and extends in the width direction. As shown in FIG. 2, a receiving plate 90 is formed continuously with the lower rear wall 87, extending from the bottom edge of the lower rear wall 87 forward in a slightly downward slope. The paper outlet 134 is formed in the rear bottom wall 85 at the center region in the paper width direction and at a location in front of and beneath the receiving plate 90. The paper outlet 134 is elongated in the paper width direction.

An inner rear wall 91 functioning as a heat shield and a positioning wall 92 are vertically erected from the receiving plate 90 forward of the lower rear wall 87 and are parallel to each other but separated a prescribed distance in the front-to-rear direction.

The inner rear wall 91 is disposed in front of and separated a prescribed interval from the lower rear wall 87. The inner rear wall 91 extends in the width direction and is parallel to the lower rear wall 87. The positioning wall 92 also extends in the width direction and is parallel to the inner rear wall 91. The positioning wall 92 is disposed in front of the inner rear wall 91 and is separated a prescribed distance therefrom. The positioning wall 92 functions to position the cleaning member 32.

A film member 117 (FIG. 2) is disposed on the front end of the receiving plate 90 for contacting the photosensitive drum 28. The film member 117 is adhesively fixed to the end face on the front end of the receiving plate 90 and protrudes upward therefrom. The film member 117 extends in the width direction and serves as a barrier between the receiving plate 90 and the photosensitive drum 28. The positioning wall 92, receiving plate 90 and film member 117 form the collecting unit 118 having a substantially rectangular shaped appearance in a side cross section, with an open top.

(b) Upper Casing

As shown in FIGS. 2 and 6, the upper casing 78 is integrally provided with a top wall 93 having a substantially rectangular plate shape, two upper side walls 94 (an upper left side wall 94*a* and an upper right side wall 94*b*) disposed at both widthwise ends of the top wall 93 and opposing each other across the width thereof, and an upper rear wall 95 disposed on the rear edge of the top wall 93. The upper left side wall 94*a* and the upper right side wall 94*b* will collectively be referred to as "upper side walls 94" hereinafter. This construction forms a substantially rectangular shape in a front view that is open on the bottom and on the front and rear sides.

The upper side walls 94 are bent downward from the widthwise edges of the top wall 93. A through-hole 116 is formed in each upper side wall 94 at positions opposite each other in the width direction. The through-holes 116 accept the insertion of the drum shaft 34 of the photosensitive drum 28. An electrode mounting part 113 is provided on the upper right side wall 94*b* for mounting the electrode plate 111 described later. Further, the upper rear wall 95 is bent diagonally downward and toward the rear from the rear edge of the top wall 93. The upper rear wall 95 forms an obtuse angle with the top wall 93 as shown in FIG. 2.

A charger support unit 96 is disposed in a front-to-rear midpoint of the top wall 93 for supporting the charger 29. A beam injection part 97 is disposed on the top wall 93 in front of the charger support unit 96 for allowing passage of a laser beam emitted from the scanning unit 19. A cleaning support part 98 for supporting the cleaning member 32 is also provided on the top wall 93 and the upper rear wall 95 to the rear of the charger support unit 96.

As shown in FIG. 2, the charger support unit 96 includes a front holding plate 99 and a rear holding plate 100 disposed at a front-to-rear midpoint of the top wall 93. The front holding plate 99 and rear holding plate 100 oppose each other in the front-to-rear direction with the grid 75 interposed therebetween.

The front holding plate 99 protrudes downward from an inner wall surface of the top wall 93 and extends in the width direction of the top wall 93. The front holding plate 99 abuts the grid 75 on the front side.

The rear holding plate 100 protrudes downward from the inner wall surface of the top wall 93 and extends in the width direction of the top wall 93 parallel to the front holding plate 99. The rear holding plate 100 abuts the grid 75 on the rear side thereof. The amount that the rear holding plate 100 protrudes from the top wall 93 is less than the protruding length of the front holding plate 99.

Hence, with the grid 75 interposed between the front holding plate 99 and rear holding plate 100, the front holding plate 99 and rear holding plate 100 grip the grid 75 in the front-to-rear direction. The discharge wire 74 spans between both upper side walls 94 and extends between the front holding plate 99 and rear holding plate 100.

The beam injection part 97 includes a beam injection opening 101 formed in front of the charger support unit 96 and having a substantially elongated rectangular shape in a plan view, extending in the width direction; and a front injection plate 102 and a rear injection plate 103 opposing each other in the front-to-rear direction with the beam injection opening 101 formed therebetween.

The front injection plate 102 protrudes at a slant downward and to the rear from the inner wall surface of the top wall 93 and extends in the width direction of the top wall 93. The front injection plate 102 is disposed on the front side of the beam injection opening 101.

The rear injection plate 103 protrudes downward from the inner wall surface of the top wall 93 and extends in the width direction of the top wall 93. The rear injection plate 103 is disposed on the rear side of the beam injection opening 101. Further, the rear injection plate 103 protrudes a shorter distance than the front injection plate 102.

In a side view, the beam injection part 97 is substantially triangular-shaped, growing narrower in the downward direction. When the scanning unit 19 emits a laser beam, the laser beam enters the beam injection opening 101, passing between the front injection plate 102 and rear injection plate 103, and is scanned in a high speed over the surface of the photosensitive drum 28.

As shown in FIG. 6, the cleaning support part 98 includes: engaging parts 104 disposed near both widthwise ends of the top wall 93 and upper rear wall 95 for engaging the support plate 66 of the cleaning member 32; and supporting pieces 105 disposed at intervals between the engaging parts 104. The engaging parts 104 include a left-side engaging part 104*a* and a right-side engaging part 104*b*.

Each engaging part 104 includes a three-sided member 109 provided on the upper rear wall 95 that when seen from the bottom appears as a rectangle with an open front side; and a front pawl 110 that confronts the three-sided member 109 in the front-to-rear direction.

The three-sided member 109 is integrally configured of an inside wall 106 extending in the front-to-rear direction on the inner side of the three-sided member 109 with respect to the width direction, an outside wall 107 extending in the front-to-rear direction on the outer side of the three-sided member 109 in the width direction, and a connecting wall 108 linking the rear edges of the inside wall 106 and outside wall 107.

The inside wall 106 is formed such that the lower edge of the inside wall 106 follows the slope of the upper rear wall 95 in order to support the support plate 66.

The outside wall 107 opposes the inside wall 106 in the width direction. The outside wall 107 protrudes farther downward than the inside wall 106 so as to contact the support plate 66 at both widthwise edges of the support plate 66 to restrict widthwise movement of the support plate 66.

A cutout part 112 is formed in the outside wall 107 of the right-side engaging part 104*b* for engaging with the electrode plate 111 described later (see FIG. 8A).

The connecting wall 108 extends in the width direction and connects the rear edges of the inside wall 106 and outside wall 107 together. The widthwise center of the connecting wall 108 protrudes forward slightly. A rear pawl 114 protruding forward is formed on this protruding portion of the connecting wall 108 (see FIGS. 8A and 8B).

The front pawl 110 is provided on the top wall 93 in front of the rear pawl 114 and confronts the rear pawl 114 in the front-to-rear direction. The front pawl 110 has a hook shape for engaging the support plate 66 (see FIGS. 8A and 8B).

The supporting pieces 105 are disposed at equal intervals between the engaging parts 104. Each supporting piece 105 protrudes from the inner wall surface of upper rear wall 95 with its bottom edge following the slope of the upper rear wall 95.

Openings 115 are formed in the upper rear wall 95 along the width direction thereof. As shown in FIG. 4, each opening 115 penetrates the upper rear wall 95 through the thickness direction thereof, forming an elongated rectangular opening extending in the width direction. The openings 115 are spaced at intervals in the width direction, such as two openings 115 between each pair of adjacent supporting pieces 105.

(2) Structure of the Cleaning Member

As described above, the cleaning member 32 includes the cleaning brush 65 and the support plate 66, shown in FIGS. 2 and 7. The support plate 66 is formed of an electrically conductive metal plate. As shown in FIGS. 8A and 8B, the support plate 66 is integrally configured of a flat plate part 72 having an elongated rectangular shape that extends along the width of the drum casing 76 (axial direction of the photosensitive drum 28), and a front bent part 68 (bent part on the upper edge when mounted on the upper casing 78) and a rear bent part 69 (bent part on the lower edge when mounted on upper casing 78) provided on both edges with respect to the vertical direction orthogonal to the longitudinal direction of the plate part 72. The front bent part 68 and the rear bent part 69 extends in the longitudinal direction. As shown in FIG. 8B, the front bent part 68 and rear bent part 69 are bent substantially in an L-shape rearward from the plate part 72. Accordingly, in a cross-sectional view, the support plate 66 forms three sides of a rectangle that is open toward the rear. As shown in FIG. 7, a pair of engagement parts 67 is provided on both longitudinal ends of the support plate 66. A right-side engagement part 67 is shown in FIG. 8A. The engagement parts 67 have the same configuration with each other.

Figure 8A:
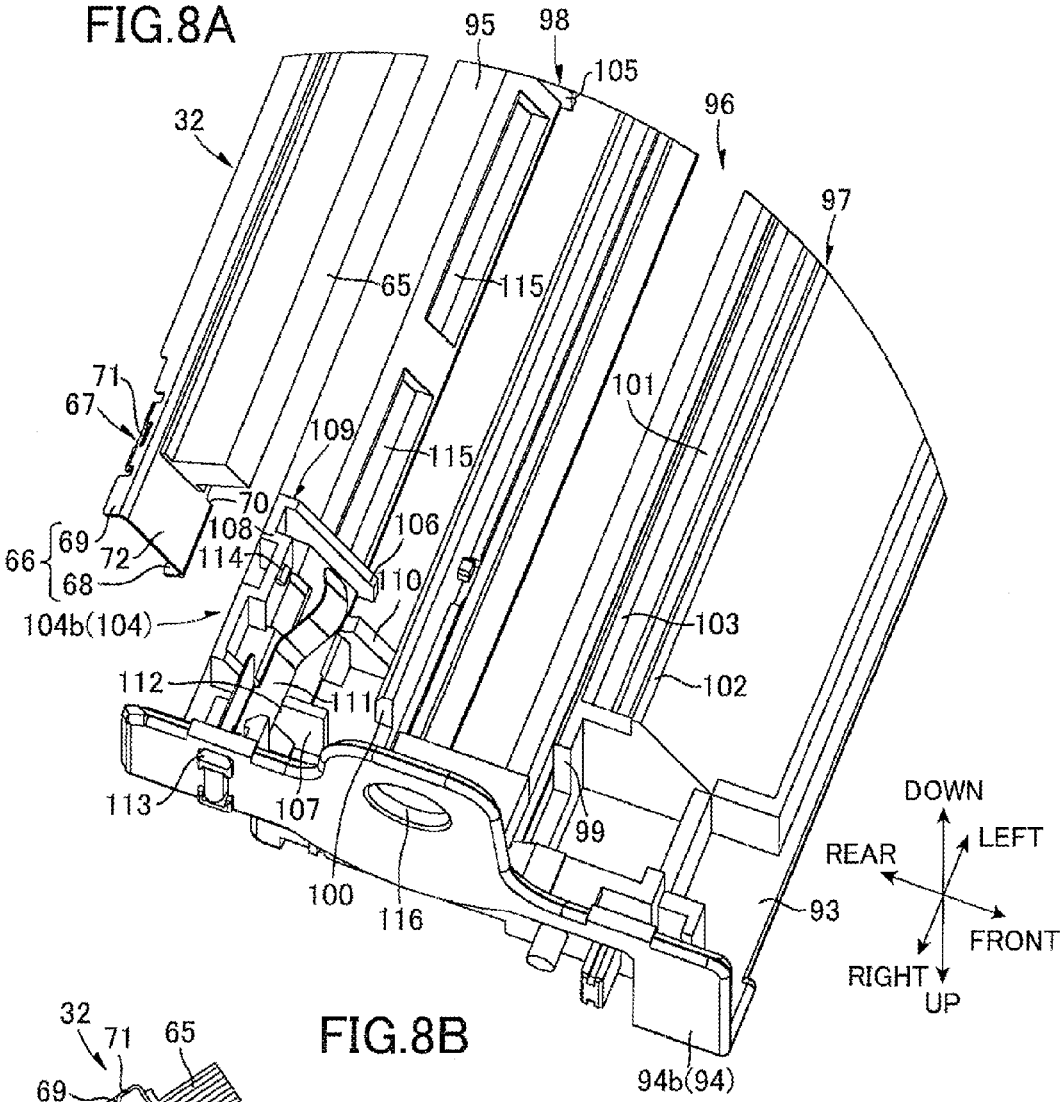
Figure 8B:
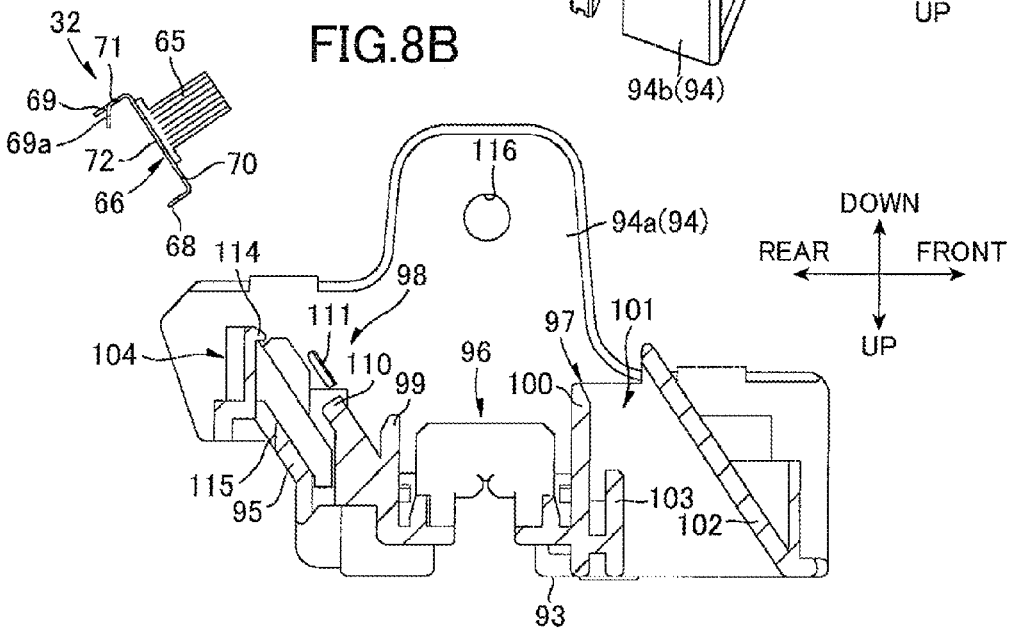

As shown in FIG. 8A, each engagement part 67 is provided with a front engaging through-hole 70 and a rear engaging through-hole 71 formed in the vertically opposing front bent part 68 and rear bent part 69, respectively. The front engaging through-hole 70 is formed in the L-shaped bent portion where the plate part 72 is bent to form the front bent part 68. Accordingly, the front engaging through-hole 70 is in an L-shape when viewed in a side cross-sectional view. At the engagement part 67, the free end of the rear bent part 69 is further bent substantially in a V-shape in a direction toward the front bent part 68 to form a V-shaped bent part 69*a*. The rear engaging through-hole 71 is formed in the V-shaped bent part 69*a*. Accordingly, the rear engaging through-hole 71 is in a V-shape when viewed in the side cross-sectional view.

The cleaning brush 65 is configured of a nonwoven cloth fixed to the surface of the plate part 72 by a double-sided tape. A plurality of electrically conductive brush bristles are erected from the nonwoven cloth at positions between the pair of engagement parts 67, forming a shape that is substantially rectangular in a side view and that extends along the longitudinal direction of the plate part 72.

(3) Mounting the Drum Casing (a) Mounting the Cleaning Member on the Upper Casing Next, the method of mounting the cleaning member 32 on the cleaning support part 98 of the upper casing 78 will be described with reference to FIGS. 8A through 10B.

As shown in FIG. 8A, first the electrode plate 111 is mounted on the upper casing 78. The electrode plate 111 will serve to urge the support plate 66 forward from the rear side thereof.

As shown in FIG. 8A, the electrode plate 111 is a metal plate that extends along the width direction of the drum casing 76 and has a curved portion on one longitudinal end thereof (the inside end in the width direction of the drum casing 76) that is curved to expand forward. The other longitudinal end of the electrode plate 111 (the outside end in the width direction of the drum casing 76) is inserted and fixed in the electrode mounting part 113 provided on the upper right side wall 94*b* with a portion midway in the longitudinal direction of the electrode plate 111 engaged in the cutout part 112 of the three-sided member 109. In this way, the electrode plate 111 is mounted on the upper casing 78 with its free longitudinal end bowed in the front-to-rear direction.

The fixed longitudinal end of the electrode plate 111 is exposed on the outside of the upper right side wall 94*b* in the width direction. When the drum cartridge 27 is mounted in the main casing 2, a terminal (not shown) provided on the main casing 2 contacts this exposed longitudinal end of the electrode plate 111, allowing a bias to be applied to the electrode plate 111 via the terminal.

Figure 9A:
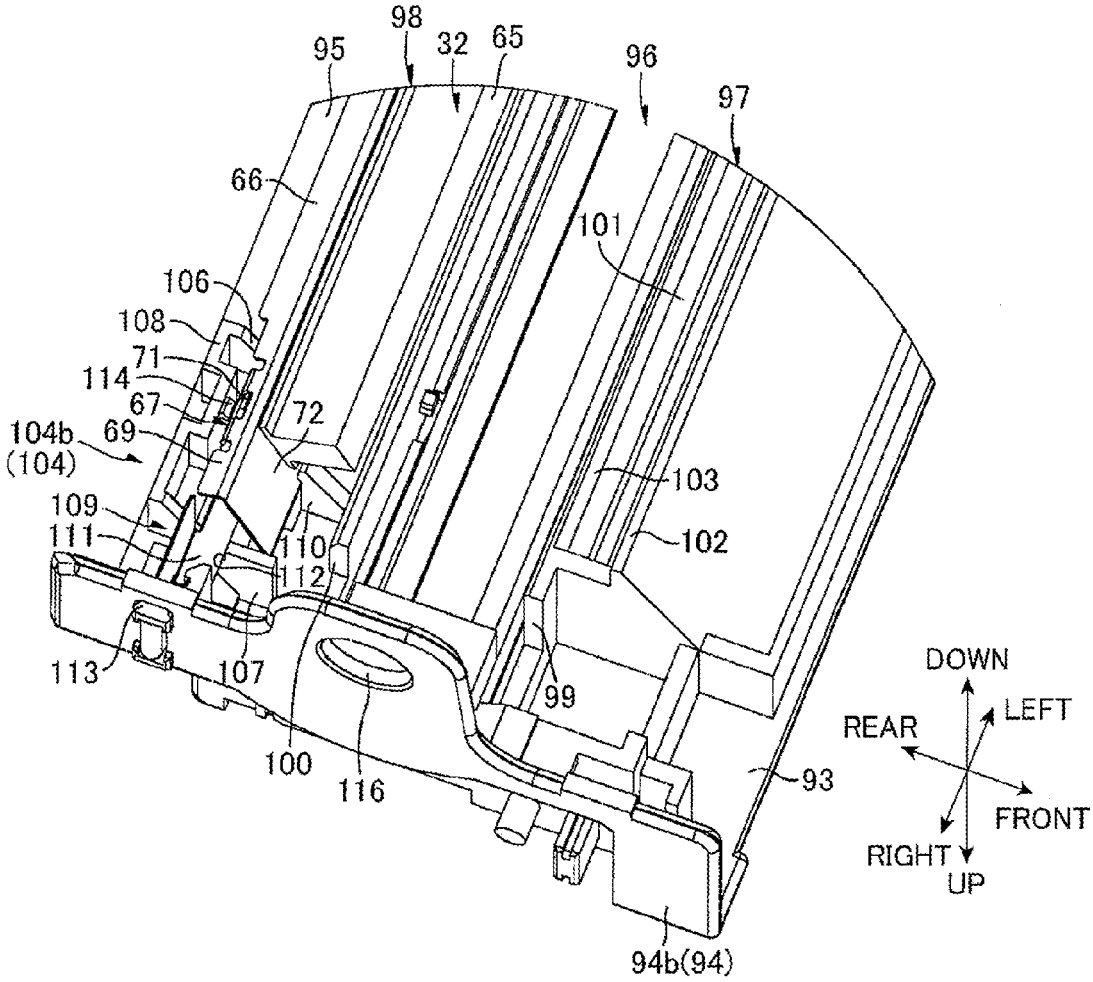
Figure 9B:
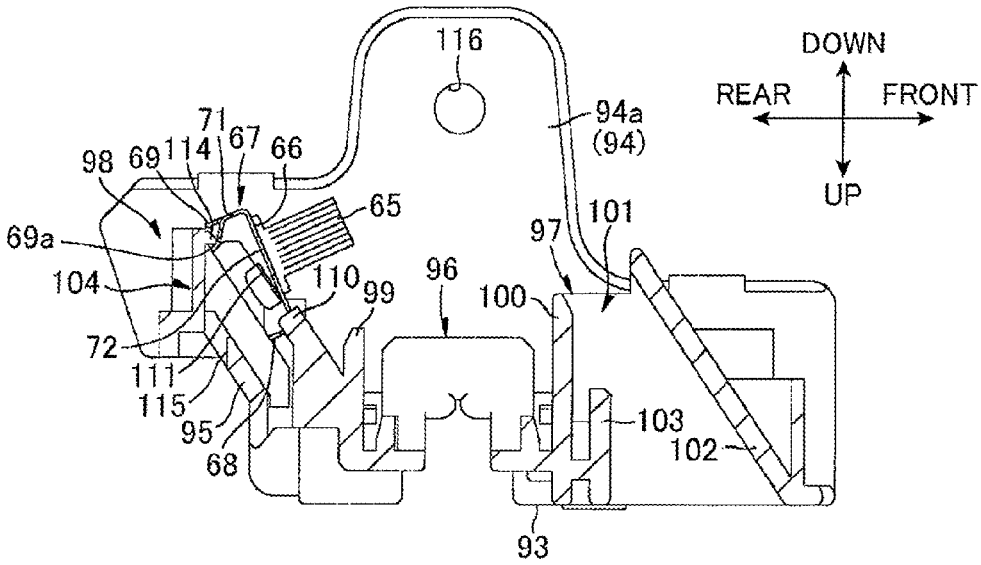

Next, the support plate 66 is positioned opposite the cleaning support part 98, as shown in FIGS. 9A and 9B, so that the front pawls 110 are inserted into and engage with the front engaging through-holes 70 of the engagement parts 67. With the front engaging through-holes 70 engaged with the front pawls 110, the support plate 66 is rotated about the front engaging through-holes 70 so that the rear bent part 69 moves rearward. Consequently, the rear engaging through-holes 71 of the engagement parts 67 are fitted over and engaged with the rear pawls 114 of the engaging parts 104, as shown in FIGS. 10A and 10B. In this way, the support plate 66 is supported on the supporting pieces 105 and the inside walls 106. As shown in FIG. 7, the support plate 66 is supported on the upper casing 78 by the engagement parts 67 engaged with the engaging parts 104 on both longitudinal ends (both widthwise ends of the drum casing 76) while widthwise movement of the support plate 66 is restricted because the support plate 66 is fitted between the outside walls 107.

When the support plate 66 is supported on the upper casing 78, the free longitudinal end of the electrode plate 111 contacts the rear side of the support plate 66 and urges the support plate 66 forward. As a result, when the drum cartridge 27 is mounted in the main casing 2, the terminal provided on the main casing 2 can apply a bias to the support plate 66 via the electrode plate 111.

(b) Mounting the Upper Casing on the Lower Casing

As described above, the upper casing 78 on which the cleaning member 32 is mounted is assembled on the lower casing 77.

With the charger 29 supported on the upper casing 78, the transfer roller 31 supported on the lower casing 77, and the main drum body 33 of the photosensitive drum 28 accommodated in the lower casing 77, the upper casing 78 is placed on top of the drum support unit 80 of the lower casing 77, as shown in FIG. 4, so that the through-holes 116 of the upper casing 78 are aligned with the through-holes 89 of the lower casing 77 in the width direction. Subsequently, the drum shaft 34 is inserted through the main drum body 33 that is disposed between the left-side through-holes 116 and 89 and the right-side through-hole 116 and 89. In this way, the upper casing 78 and lower casing 77 are attached via the drum shaft 34.

When the upper casing 78 is attached to the lower casing 77, the rear bent part 69 of the support plate 66 contacts the positioning wall 92 provided on the receiving plate 90 of the lower casing 77 (see FIG. 2), thereby fixing the position of the cleaning brush 65 relative to the photosensitive drum 28. Further, the collecting unit 118 is disposed below the cleaning brush 65.

Further, the openings 115 in the upper casing 78 are located diagonally upward and rearward from the support plate 66. The openings 115 are formed in the upper rear wall 95. The support plate 66 confronts the rear wall 95 with a space or gap being formed between the support plate 66 and the rear wall 95. The support plate 66 faces the openings 115 with no member being located in the space between the support plate 66 and the openings 115. In other words, no member is located blocking any straight-line-shaped communication path between the support plate 66 and the openings 115. The support plate 66 is in communication with the exterior of the casing via the openings 115. In other words, the support plate 66 can be seen from outside of the drum casing 76 through the openings 115. More specifically, as shown in FIG. 11A, a boundary imaginary straight line 301 is defined connecting a lower edge of each opening 115 and a lower edge of the support plate 66. Another boundary imaginary straight line 302 is defined connecting an upper edge of each opening 115 and an upper edge of the support plate 66. No member is located in the space defined between the boundary imaginary straight lines 301 and 302 for all the openings 115. It is noted that some member may be located in the space defined between the boundary imaginary straight lines 301 and 302 for some opening 115 as long as at least one straight line-shaped space is partially remained as connecting at least one opening 115 and the support plate 66. This ensures that at least a part of the support plate 66 can be seen from outside the drum casing 76 via at least one opening 115.

Further, the openings 115 are provided diagonally upward and rearward of the collecting unit 118, with the support plate 66 blocking communication between the openings 115 and the collecting unit 118.

The openings 115 are also disposed so as to oppose the charger 29 in the front-to-rear direction, enabling communication therebetween. The support plate 66 is disposed along the bottom of the communication path between the openings 115 and the charger 29.

The openings 115 are also provided above the lower rear wall 87 of the lower casing 77 and diagonally above and rearward of the cleaning member 32. The openings 115 are also provided diagonally below and forward of the duct 120 when the drum casing 76 is mounted in the main casing 2.

(4) Operations and Effects of the Drum Casing and the Cleaning Member

In the drum cartridge 27 described above, the cleaning member 32 faces the exterior of the drum casing 76 via the openings 115 formed in the upper casing 78. Accordingly, the rear wall 95 of the drum casing 76 does not completely block the rear side of the cleaning member 32 opposite the side facing the photosensitive drum 28, but rather the rear side of the cleaning member 32 is in direct communication with the exterior of the drum casing 76 via the openings 115. Therefore, if the interior of the drum casing 76 reaches high temperatures, the hot air does not accumulate in the drum casing 76 but dissipates out of the drum casing 76 via the openings 115. As a result, the cleaning member 32 can be cooled through a simple structure, suppressing a rise in temperature of the cleaning member 32 and preventing toner deposited on the cleaning brush 65 from becoming soft, thereby preventing filming on the photosensitive drum 28.

Further, the rear wall 95 covers the cleaning member 32 while allowing the cleaning member 32 to face the exterior of the drum casing 76 via the openings 115. The cleaning member 32 is not exposed outside directly. Hence, the cleaning member 32 can be protected by the rear wall 95 from direct contact with members outside the drum casing 76. Accordingly, it is possible to prevent the cleaning member 32 from being shifted in position due to contact with members outside the drum casing 76 and, consequently, to prevent damage to the photosensitive drum 28.

Further, this structure of the cleaning member 32 can firmly support the cleaning brush 65 on the support plate 66 while reliably scraping paper dust off the photosensitive drum 28 with the fibrous cleaning brush 65. Since the support plate 66 supports the cleaning brush 65 on the side opposite the photosensitive drum 28 while directly facing the openings 115, this structure can prevent paper dust captured by the cleaning brush 65 from escaping through the openings 115 and scattering outside the drum casing 76. Further, forming the support plate 66 of a metal plate having a thin shape enhances the cooling effectiveness.

Since the support plate 66 is supported on the drum casing 76 at both longitudinal ends thereof, the cleaning member 32 can also be reliably supported. Specifically, the engagement parts 67 are disposed on both longitudinal ends of the support plate 66, and the engaging parts 104 are provided on the upper casing 78 for engaging the engagement parts 67. Hence, the support plate 66 can be reliably supported by engaging the engagement parts 67 of the support plate 66 with the engaging parts 104 on the upper casing 78.

More specifically, each engagement part 67 of the support plate 66 includes the front engaging through-hole 70 and rear engaging through-hole 71 disposed on both longitudinal ends of the support plate 66 and opposing each other from a distance in the vertical direction. Each engaging part 104 of the engagement part 67 includes the front pawl 110 for engaging with the front engaging through-hole 70, and the rear pawl 114 for engaging with the rear engaging through-hole 71.

When mounting the cleaning member 32, the front engaging through-holes 70 are first fitted over and engaged with the respective front pawls 110. Subsequently, the support plate 66 is rotated rearward about the front engaging through-holes 70 until the rear engaging through-holes 71 are fitted over and engaged with the respective rear pawls 114, thereby supporting the support plate 66 on the upper casing 78. Hence, it is possible to reliably support the support plate 66 on the upper casing 78 through a simple assembly process.

Further, in the mounting procedure, reliable engagement can be achieved through a simple construction involving inserting the front pawls 110 in the front engaging through-holes 70 and inserting the rear pawls 114 in the rear engaging through-holes 71.

Supporting the support plate 66 on the drum casing 76 at both longitudinal ends in this way requires no additional member to support the support plate 66 in regions other than the longitudinal ends. Hence, the support plate 66 can be reliably supported opposite the openings 115 through a simple construction.

Using a bias applied to the support plate 66 via the electrode plate 111, the cleaning brush 65 can electrically attract paper dust. Further, since the side of the support plate 66 opposite the cleaning brush 65 is open, the electrode plate 111 can be provided on this side for urging the support plate 66. Hence, a bias can reliably be applied to the support plate 66 through a simple construction.

The support plate 66 is also disposed so as to block communication between the openings 115 and the collecting unit 118. Therefore, paper dust collected in the collecting unit 118 is prevented from dispersing through the openings 115.

Since the support plate 66 is disposed in the bottom of the communication path between the openings 115 and the charger 29, ozone generated by the charger 29 can be used to cool the support plate 66 while the ozone is exhausted through the openings 115.

Since the rear holding plate 100 for holding the charger 29 on the side nearest the openings 115 protrudes a shorter length than the front holding plate 99, airflow from the charger 29 to the openings 115 can be easily generated. As a result, ozone produced from the charger 29 can be more easily discharged through the openings 115.

When the process cartridge 20 is mounted in the main casing 2 of the laser printer 1, the fixing unit 21 and photosensitive drum 28 are separated from each other in a horizontal direction, and hot air generated from the heating roller 60 in the fixing unit 21 radiates and flows toward the photosensitive drum 28 of the process cartridge 20. Since the cleaning member 32 is disposed between the fixing unit 21 and photosensitive drum 28 substantially in a horizontal direction, the cleaning member 32 is susceptible to a temperature increase caused by the hot air from the fixing unit 21.

However, the process cartridge 20 includes the lower rear wall 87 on the lower casing 77 to the rear of the cleaning member 32. Thus, the lower rear wall 87 can prevent hot air generated from the heating roller 60 in the fixing unit 21 from contacting the cleaning member 32. This construction can prevent the cleaning member 32 from heating up. By suppressing a rise in temperature of the cleaning member 32 in this way, this construction prevents filming on the photosensitive drum 28.

In addition to the lower rear wall 87, the inner rear wall 91 is disposed on the lower casing 77 in front of the lower rear wall 87 and runs parallel to the lower rear wall 87 so that the lower rear wall 87 and inner rear wall 91 are stacked in the front-to-rear direction that is, in the outside-to-inside direction. In other words, the lower rear wall 87 and the inner rear wall 91 extend parallel to each other, and the inner rear wall 91 is positioned on the front side, that is, on the inner side relative to the lower rear wall 87. A space is formed between the lower rear wall 87 and the inner rear wall 91. The space serves as a heat shielding chamber. Hence, this construction further enhances the heat shielding effect and further prevents the cleaning member 32 from rising in temperature.

As shown in FIG. 11B, a boundary imaginary straight line 303 is defined connecting an upper edge of the lower rear wall 87 and an upper edge of a region of the cleaning brush 65 that contacts the photosensitive drum 28. Another boundary imaginary straight line 304 is defined connecting a lower edge of the lower rear wall 87 and a lower edge of the region of the cleaning brush 65 that contacts the photosensitive drum 28. The inner rear wall 91 protrudes from the receiving plate 90 with its upper edge being located between the boundary imaginary straight lines 303 and 304. However, the protruding amount of the inner rear wall 91 from the receiving plate 90 can be changed so that the upper edge of the inner rear wall 91 becomes higher than the boundary imaginary straight line 303. The protruding amount of the inner rear wall 91 can be freely changed as long as the upper edge of the inner rear wall 91 be upper than the boundary imaginary straight line 304.

By disposing the cleaning member 32 so as to be in direct communication with the outside of the drum casing 76 via the openings 115 with no member being located between the cleaning member 32 and the openings 115, hot air generated in the fixing unit 21 does not remain trapped in the drum casing 76, but dissipates out of the drum casing 76 through the openings 115. Hence, this structure suppresses temperature rises in the cleaning member 32, preventing filming on the photosensitive drum 28.

Specifically, by providing the openings 115 above the lower rear wall 87 in the lower casing 77, the lower rear wall 87 prevents hot air outside of the drum casing 76 from striking the cleaning member 32, while hot air inside the drum casing 76 can dissipate out of the drum casing 76 through the openings 115, thereby efficiently cooling the cleaning member 32. As a result, this structure suppresses temperature rises in the cleaning member 32 and prevents filming on the photosensitive drum 28.

By forming the openings 115 diagonally above and rearward of the cleaning member 32, hot air that rises around the cleaning member 32 can be efficiently exhausted through the openings 115. In the laser printer 1, hot air generated from the heating roller 60 in the fixing unit 21 radiates and flows toward the photosensitive drum 28 of the process cartridge 20. However, since the upstream end portion 120*b* of the duct 120 is disposed between the fixing unit 21 and the process cartridge 20, the duct 120 can guide the hot air toward the exhausting fan 119, while the exhausting fan 119 exhausts the air out of the main casing 2. Hence, this construction further prevents the cleaning member 32 from becoming hot.

Further, when the process cartridge 20 is mounted in the main casing 2, the openings 115 are located diagonally below and forward of the duct 120. Accordingly, hot air in the drum casing 76 can pass through the openings 115 to be guided through the duct 120 and exhausted by the exhausting fan 119, while hot air flowing from the fixing unit 21 to the photosensitive drum 28 can be guided through the duct 120 and discharged by the exhausting fan 119. Hence, this construction efficiently exhausts hot air from the main casing 2.

The laser printer 1 described above includes the drum cartridge 27 that can suppress temperature rises in the cleaning member 32 to prevent filming on the photosensitive drum 28, thereby achieving high-quality image formation.

Figure 12:
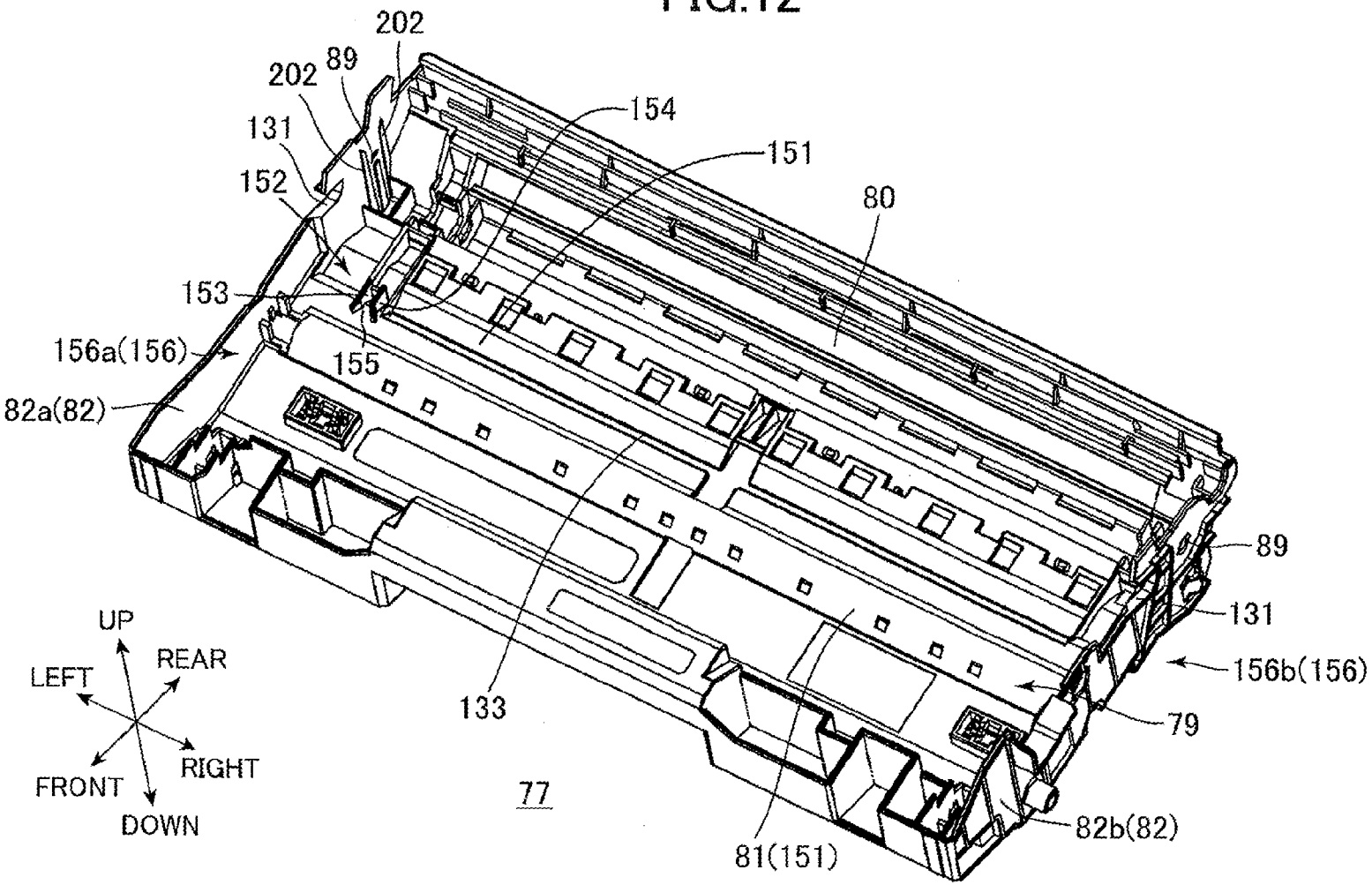
FIG. 12 illustrates an engaging unit provided on the lower casing of the drum cartridge.
Figure 14:
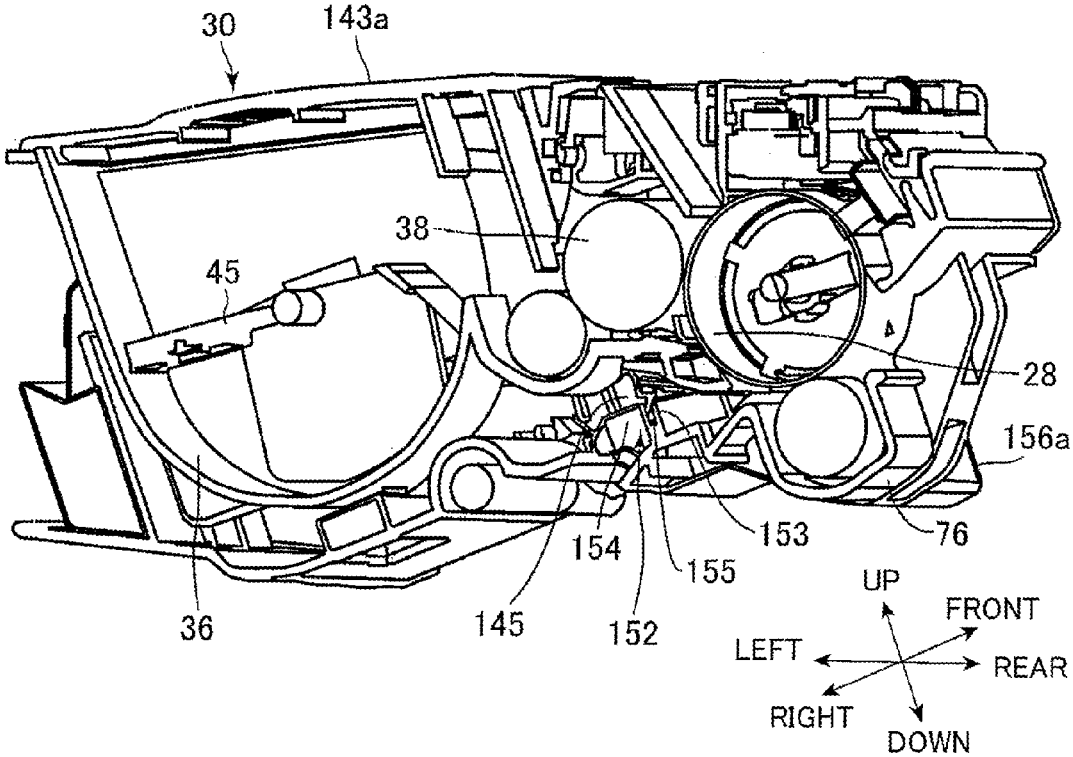
FIG. 14 is a perspective view with a portion cut away, illustrating the structure for positioning the drum cartridge and developer cartridge relative to each other in a paper width direction (left-to-right direction) when the developer cartridge is mounted in the drum cartridge.

3. Structure for Positioning Cartridges (1) Structure for Positioning the Drum Cartridge and Developer Cartridge in the Front-to-rear and Vertical Directions FIG. 11A and FIG. 12 illustrate the mechanism provided on the drum casing 76 to position the developer cartridge 30 relative to the drum casing 76. FIG. 11B illustrates how the developer cartridge 30 is mounted on the drum casing 76. FIGS. 11A, 11B, and 12 correspond to FIGS. 2, 3, and 5 respectively. However, in FIGS. 11A, 11B, and 12 several parts have been omitted from the drawings in order to clarify explanation of positioning the drum casing 76 and the developer cartridge 30. FIG. 13 is a perspective view of the developer cartridge 30 from the bottom side. FIG. 14 is a perspective view of a left side end part of the process cartridge 20 with a remaining portion cut away, showing the structure for positioning the drum casing 76 and developer cartridge 30 in the paper width direction when the developer cartridge 30 is mounted on the drum casing 76.

The drum casing 76 rotatably supporting the cylindrical photosensitive drum 28 is detachably mounted in the main frame 200. The developer casing 36 is detachably mounted on the drum casing 76. Further, the developing roller 38 that is capable of carrying toner on the peripheral surface thereof is rotatably supported in the developer casing 36 so that the developing roller 38 will be parallel to and oppose the photosensitive drum 28, when the developer casing 36 is mounted on the drum casing 76.

As shown in FIGS. 11A and 12, the developer cartridge mounting unit 79 is formed in the drum casing 76 to the front side of the drum support unit 80 where the photosensitive drum 28 is mounted. The developer cartridge mounting unit 79 is an internal space enclosed by the front bottom wall 81 and two front side walls 82*a* and 82*b*. As shown in FIG. 11B, the developer cartridge mounting unit 79 is configured for accommodating the developer cartridge 30 so that the peripheral surface 53*a* of the rubber roller 53 in the developing roller 38 contacts the peripheral surface 33*a* of the photosensitive drum 28 via a thin layer of toner carried on the peripheral surface 53*a*.

As shown in FIGS. 11A and 12, a pair of positioning recesses 131 are formed in the pair of side walls 86*a* and 86*b* respectively. Each positioning recess 131 extends in a direction toward the metal drum shaft 34 of the photosensitive drum 28 where photosensitive drum 28 is mounted in the drum casing 76. As shown in FIG. 11B, the positioning recesses 131 serve to accommodate the roller shaft 52 of the developing roller 38 when the developer cartridge 30 is mounted on the drum casing 76. Each positioning recess 131 has an endface 132 opposing the metal drum shaft 34 of the photosensitive drum 28, and the roller shaft 52 of the developing roller 38 is in contact with the endface 132 when the developer cartridge 30 is mounted in the drum casing 76. The positioning recess 131 and endface 132 are formed to set the relative position of the photosensitive drum 28 and developing roller 38 in the front-to-rear and vertical directions.

(2) Structure for Positioning the Developer Casing and the Developing Roller in the Paper Width Direction As shown in FIG. 11B, a pair of pins 207 are erected from the left side end on the roller shaft 52 of the developing roller 38 with respect to the widthwise direction. The pins 207 are erected from a prescribed position on the roller shaft 52 near to the left side edge thereof. When the developing roller 38 is mounted in the developer casing 36, the left side edge of the roller shaft 52 protrudes outwardly (leftwardly) from the left side wall 143*a* and the right side edge of the roller shaft 52 protrudes outwardly (rightwardely) from the right side wall 143*b*. The pins 207 contact an inner side surface of the left side wall 143*a*, thereby setting the position of the developing roller 38 relative to the developer casing 36 in the paper width direction. It is noted that when the developer casing 36 is mounted on the developer cartridge mounting unit 79, the left side wall 143*a* of the developer casing 36 opposes the left side wall 156*a* of the drum casing 76.

(3) Structure for Positioning the Drum Cartridge and Developer Cartridge in the Paper Width Direction As shown in FIG. 12, the engaging unit 152 is formed on a left-side end of the bottom wall 151 in the paper width direction. The engaging unit 152 is located near to the left side wall 156*a*. The engaging unit 152 is formed on the left side of the left-side edge of the paper inlet 133 in the paper width direction. The engaging unit 152 is configured of ribs 153 and 154 erected upward from the bottom wall 151 and substantially parallel to the side walls 156. A gap 155 of a prescribed width is formed between the ribs 153 and 154 in the width direction of the drum cartridge 76. Each rib 153, 154 has a plate shape extending orthogonal to the paper width direction and having a thickness in the paper width direction.

As shown in FIG. 13, a positioning rib 145 is formed on a left-side end of the bottom wall 141 of the developer casing 36 in the paper widthwise direction. The positioning rib 145 is positioned near a side cover 146 that is provided outside the left-side wall 143*a* in the paper width direction. A coupling member 147 is provided on the side cover 146. An input shaft (not shown) provided on the main frame 200 (see FIG. 15) can be inserted into the coupling member 147. With the input shaft inserted into the coupling member 147 when the developer casing 36 is mounted in the laser printer 1, a driving force from a motor (not shown) provided on the main frame 200 can be transmitted via the coupling member 147 to the developer cartridge 30 for rotating the developing roller 38. The positioning rib 145 is formed near the coupling member 147. The positioning rib 145 is a plate shape extending orthogonal to the paper width direction and having a thickness in the paper width direction.

FIG. 14 shows the state how the developer cartridge 30 is mounted on the drum casing 76. As shown in FIG. 14, the gap 155 between the ribs 153 and 154 and the thickness of the positioning rib 145 in the paper width direction are set so that the positioning rib 145 can be fitted into the gap 155 with a prescribed fitting tolerance. By fitting the positioning rib 145 into the engaging unit 152, it is possible to position the drum casing 76 and developer casing 36 relative to each other in the paper width direction when the developer cartridge 30 is mounted in the drum casing 76 (drum cartridge 27).

In other words, the positioning rib 145 is formed on the developer casing 36 for positioning the developer casing 36 relative to the drum casing 76 in the paper width direction. Further, the engaging unit 152 is formed on the drum casing 76 for engaging with the positioning rib 145 in order to position the developer casing 36 relative to the drum casing 76 in the paper width direction.

As shown in FIG. 14, the engaging unit 152 and positioning rib 145 are disposed almost directly below the developing roller 38 (that is, near the rotational shaft 52 of the developing roller 38).

(4) Structure for Positioning the Drum Cartridge and the Photosensitive Drum

FIG. 15 is a horizontal cross-sectional view showing how the drum casing 76 is mounted in the main frame 200. In FIG. 15, the developer cartridge 30 (see FIG. 1) mounted in the developer cartridge mounting unit 79 has been omitted from the drawing.

As shown in FIG. 15, a drum gear 241 is provided on the left-side end of the photosensitive drum 28. An extension tube 242 is formed on a right side surface of the drum gear 241. The drum gear 241 is fixed to the photosensitive drum 28 by inserting the extension tube 242 into the left-side end of the main drum body 33 at a prescribed fitting tolerance so that the drum gear 241 cannot rotate relative to the main drum body 33. The drum gear 241 is mounted on the main drum body 33 so that the right side surface of the drum gear 241 is in contact with a left endface 232 of the main drum body 33. The drum gear 241 is coupled to a main drive gear (not shown) provided on the main frame 200 so that a driving force can be transmitted to the photosensitive drum 28 via the drum gear 241.

An endface 243 on the left side of the drum gear 241 is formed with a prescribed flatness. As shown in FIGS. 12 and 15, a pair of protruding parts 201 are formed in the left side wall 156*a* (more specifically the rear left-side wall 86*a*) at a position opposing the endface 243 of the drum gear 241. Each protruding part 201 has an endface 202 opposing the drum gear 241, and is formed with a prescribed flatness. The through-hole 89 is formed between the pair of the protruding parts 201.

A flange part 234 is mounted on the right end of the main drum body 33 and is in contact with an endface 233 on the right end of the main drum body 33.

A spacer 246 interposed between two felt members 245 is disposed outside (right side) of the flange part 234 in the paper width direction. Hence, the felt members 245 are interposed between the flange part 234 and spacer 246 and between the spacer 246 and the right side wall 156*b* (right side wall 86*b*). The felt members 245 are capable of compressing elastically in the paper width direction. A spring (not shown) that is provided inside of the main drum body 33 urges the main drum body 33 and drum gear 241 leftward. Hence, the photosensitive drum 28 is disposed in the drum casing 76 so that the endface 243 is in contact with the endfaces 202 of the protruding parts 201 opposing the drum gear 241. Through the contact between the endfaces 202 and the endface 243, the photosensitive drum 28 can be positioned relative to the drum casing 76 in the paper width direction.

Specifically, the position of endfaces 202 of the protruding parts 201 relative to the engaging unit 152 and the position of the positioning rib 145 relative to the inner side surface of the left side wall 143*a* in the paper width direction are set so that when the developer cartridge 30 is accommodated in the developer cartridge mounting unit 79 of the drum casing 76, the entire length of the effective latent image forming region 236 successfully falls within the entire length of the effective image forming region on the peripheral surface 53*a* with respect to the paper width direction. Accordingly, the pair of effective region boundaries 235 of the effective latent image forming region 236 successfully fall within the effective image forming region on the peripheral surface 53*a* with respect to the paper width direction.

(5) Structure of a Positioning Mechanism for the Main Frame and Process Cartridge As shown in FIG. 15, a left side frame 211 and a right side frame 221 are fixed to inside surfaces of the main frame 200.

A guiding groove 213 is formed in the left side frame 211, which is disposed opposite the left side wall 156*a* of the drum casing 76 when the drum casing 76 is mounted in the main casing 2. Specifically, the guiding groove 213 is formed in an upper portion of the left side frame 211 on the inner side in the paper width direction. The guiding groove 213 is rectangular when viewed from the front side (from the bottom of FIG. 15) and extends in the paper-conveying direction (front-to-rear direction). The side surface of the guiding groove 213 includes an introducing surface 217 in the front section that runs parallel to the main frame 200 and to the paper-conveying direction, and a slanted surface 218 formed on the rear side of the introducing surface 217 slanting inward in the paper width direction. A depression 214 is formed in the end of the guiding groove 213 on the rear side of the slanted surface 218 for accommodating the drum shaft 34 of the photosensitive drum 28.

A rear end 215 constituting the rear surface of the depression 214 forms an end of the guiding groove 213 on the rear surface side. Hence, the positions of the drum casing 76 and photosensitive drum 28 with respect to the main frame 200 in the paper-conveying direction are determined by the peripheral surface of the metal drum shaft 34 of the photosensitive drum 28 contacting the rear end 215.

The depression 214 has a side endface 216 that forms the end (left end) of the depression 214 in the paper width direction. The side endface 216 is formed with a prescribed flatness. When an axial end 231 of the metal drum shaft 34 contacts the side endface 216, the positions of the drum casing 76 and photosensitive drum 28 with respect to the main frame 200 in the paper width direction are determined. Hence, the mechanism for determining the relative positions of the main frame 200 and drum casing 76 in the paper width direction parallel to the rotational axis of the photosensitive drum 28 is configured of the left side frame 211 having the depression 214, and the left side wall 86*a* having the protruding part 201.

On the drum casing 76, the engaging unit 152 is positioned relative to the end faces 202 protruding parts 201 in the paper width direction to ensure that the engaging unit 152 is located between the drum gear 241 and the left-side effective region boundary 235*a* when the photosensitive drum 28 is mounted on the drum casing 76. This ensures that the engaging unit 152 be located in the outside (left side) of the effective latent image forming region 236. Additionally, on the developer casing 36, the positioning rib 145 is positioned relative to the inner side surface of the positioning rib 145 in the paper width direction to ensure that the left side wall 143*a* is located on the outside (that is, on the left side) of the effective image forming region on the peripheral surface 53*a* of the developing roller 38. Accordingly, when the developer casing 36 is mounted on the drum casing 76, it is ensured that the engaging unit 152 and positioning rib 145 are disposed outside the effective latent image forming region 236 and the effective image forming region. The engaging unit 152 and positioning rib 145 are disposed near the left side frame 211 and the left-side wall 156*a* that make up the positioning mechanism for positioning the main frame 200 and drum casing 76 relative to each other.

A guiding groove 222 is formed in the right side frame 221 that opposes the right side wall 156*b* of the drum casing 76 when the drum casing 76 is mounted in the main casing 2. Specifically, the guiding groove 222 is formed in an upper portion of the right side frame 221 on the inner side in the paper width direction. The guiding groove 222 has a rectangular shape when viewed from the front side and extends in the paper-conveying direction. The inside surface of the guiding groove 222 extends parallel to the main frame 200 and to the paper-conveying direction to a rear endface 223 on the rear side of the guiding groove 222. In other words, the guiding groove 222 does not have a portion corresponding to the slanted surface 218 and depression 214 of the guiding groove 213. A leaf spring 225 is disposed on an end of the guiding groove 222 near the rear surface thereof. The leaf spring 225 urges the metal drum shaft 34 of the photosensitive drum 28 inward in the paper width direction (leftward) so as to maintain the axial end 231 in contact with the side endface 216. Further, the main drum body 33 is electrically connected to the grounded right side frame 221 and main frame 200 via the leaf spring 225 and metal drum shaft 34.

The left side frame 211 also includes a plate-shaped lower guiding groove plate 219 that extends inward in the paper width direction, and is disposed below the guiding groove 213 to define the bottom surface of the guiding groove 213 thereon. Similarly, the right side frame 221 includes a plate-shaped lower guiding groove plate 224 that extends inward in the paper width direction below the guiding groove 222 to define the bottom surface of the guiding groove 222 thereon. The lower guiding groove plates 219 and 224 oppose each other at the same height. When mounting the drum casing 76 in the main frame 200, the lower guiding groove plates 219 and 224 function to support the peripheral surface on the metal drum shaft 34 of the photosensitive drum 28 as the drum casing 76 is slid rearward. By resting the metal drum shaft 34 of the photosensitive drum 28 on the lower guiding groove plates 219 and 224 while the metal drum shaft 34 is in contact with the rear end 215 of the guiding groove 213 and the rear endface 223 of the guiding groove 222, the positions of the drum casing 76 and photosensitive drum 28 relative to the main frame 200 in the height direction are fixed.

(6) Operations and Effects of Positioning Drum Cartridge and Developer Cartridge, Drum Cartridge and Photosensitive Drum, and Main Frame and Process Casing Relative to Each Other As shown in FIG. 14, it is possible to easily and reliably position the drum casing 76 and developer casing 36 relative to each other in the paper width direction by engaging the positioning rib 145 in the engaging unit 152.

As shown in FIGS. 12 and 13, the engaging unit 152 and positioning rib 145 are formed on the left end of the drum casing 76 and developer casing 36, respectively, in the paper width direction. This construction allows a reduction in dimensional tolerance since the distance from reference surfaces (the left-side wall 156*a* of the drum casing 76 and left side wall 143*a* of the developer casing 36) to the engaging unit 152 and to the positioning rib 145 is small. That is, the distance from the left-side wall 143*a* to the positioning rib 145 is small. The distance from the left side wall 156*a* to the engaging unit 152 is small. Therefore, it is possible to accurately position the drum casing 76 relative to the developer cartridge 30.

Here, the distance from the positions at which the positioning rib 145 and engaging unit 152 are formed, to the reference surfaces (the left-side wall 156*a* and left side wall 143*a*) on the developer accommodating unit 79 and developer casing 36 are smaller than the width of the drum casing 76 and the width of the developer cartridge 30. More specifically, the distance from the positions at which the positioning rib 145 and engaging unit 152 are formed, to the reference surfaces (the left-side wall 156*a* and left side wall 143*a*) is less than one-half the width of the developer accommodating unit 79 and the width of the developer cartridge 30. Therefore, a smaller dimensional tolerance may be given to the dimensions from the positions at which the positioning rib 145 and engaging unit 152 are formed to the respective reference surfaces (the left-side wall 156*a* and left side wall 143*a*).

The thickness of the positioning rib 145 and the distance between the ribs 153 and 154 in the engaging unit 152 are much smaller than the width of the developer cartridge accommodating unit 79 and the width of the developer cartridge 30. Therefore, it is possible to reduce play when the positioning rib 145 is engaged with the engaging unit 152.

As shown in FIG. 14, the engaging unit 152 is configured of the pair of ribs 153 and 154 opposing each other across a narrow gap 155. This construction can reduce the fitting tolerance of the positioning rib 145 in the gap 155 and can ensure reliable mounting of the developer cartridge 30 on the drum casing 76 with no relative movement between the drum casing 76 and developer casing 36 in the paper width direction. Accordingly, it is possible to set external dimensions of the drum casing 76 and developer casing 36 in the paper width direction with a relatively large widthwise clearance between the side walls 156 (see FIG. 12) and the opposing side walls 143 (see FIG. 13). Hence, the developer cartridge 30 can be smoothly and reliably mounted on the drum casing 76 and accurately positioned thereon.

The drum casing 76 and developer casing 36 are positioned relative to each other by the engaging unit 152 and positioning rib 145 (see FIG. 14) at a location near the left side frame 211 and the left side walls 156*a* that configure the positioning mechanism for positioning the drum casing 76 relative to the main frame 200. Such positioning is performed by engaging the positioning rib 145 with the engaging unit 152 near the coupling member 147 (see FIG. 13) and the drum gear 241 via which a rotational driving force is transmitted. Further, the positioning rib 145 is disposed near the rotational axis of the developing roller 38.

This construction can suppress side-to-side oscillations (in a direction parallel to the paper width direction) produced in the developer casing 36 when the rotational driving force is transmitted, in order to maintain the developer cartridge 30 in a stable mounted state on the drum casing 76. Consequently, wear and damage to the engaging unit 152 and positioning rib 145 can be suppressed. Further, the main frame 200, drum casing 76, and developer casing 36 can be accurately positioned relative to each other.

The photosensitive drum 28 and developing roller 38 are positioned in the paper width direction so that the effective latent image forming region 236 on the photosensitive drum 28 substantially coincides with the effective image forming region on the peripheral surface 53*a* of the developing roller 38 in the paper width direction. Consequently, charged toner of a prescribed density and a prescribed charge amount that is carried on the peripheral surface 53*a* of the developing roller 38 can be reliably supplied across the entire width of the electrostatic latent image formed on the peripheral surface of the photosensitive drum 28, thereby properly developing the electrostatic latent image with toner.

The engaging unit 152 is formed outside the effective latent image forming region 236. That is, the engaging unit 152 is on the left of the left-side effective region boundary 235*a*. The engaging unit 152 is on the left side of the left-side paper inlet 133. The positioning rib 145 is formed outside (left side) the effective image forming region of the developing roller 38. Accordingly, the engaging unit 152 and positioning rib 145 can be disposed reliably on the left ends of the drum casing 76 and developer casing 36, respectively, in the paper width direction. Hence, the drum casing 76 and developer casing 36 can be reliably positioned in the paper width direction, while configuring a paper-conveying path that enables paper to be smoothly conveyed within the effective latent image forming region and effective image forming region.

While the invention has been described in detail with reference to the above aspects thereof, it would be apparent to those skilled in the art that various changes and modifications may be made therein without departing from the spirit of the invention.

(a) For example, the above-described positioning mechanisms can be applied to various types of image-forming device including the laser printer. Further, the drum casing 76 may be configured to only accommodate and support the photosensitive drum 28 but not to include other parts, for example, the developing roller 38. Further, the drum casing 76 configured to accommodate and support the photosensitive drum 28 may constitute a portion of the main frame 200. In other words, the drum casing 76 may be fixed to the main frame 200. The developer cartridge 30 may be detachably mounted in the main frame 200.

(b) The engaging unit 152 is not limited to the structure configured of the plurality of ribs 153 and 154. The engaging unit 152 may be modified to have other various structures. For example, the engaging unit 152 may be configured of a depressed part or a through-hole formed in the bottom wall 151.

(c) In the above description, the engaging unit 152 is formed in the drum casing 76 and the positioning rib 145 is formed in the developer casing 36. However, the engaging unit 152 may be formed in the developer casing 36, while the positioning rib 145 is formed in the drum casing 76. Also, in this case, the engaging unit 152 may be configured of a depressed part, a through-hole, a plurality of ribs, or the like.

(d) While the engaging unit 152 and the positioning rib 145 are positioned on the left ends in the paper width direction in the above description, the positions of the engaging unit 152 and positioning rib 145 are not limited to these positions.

(e) In the above description, the photosensitive drum 28 and developing roller 38 are positioned relative to each other in the paper width direction when the positioning rib 145 is engaged in the engaging unit 152 to position the drum casing 76 and developer casing 36 relative to each other in the paper width direction. However, the combination of the positioning rib 145 and the engaging unit 152 may be modified so as to position the drum casing 76 and developer casing 36 relative to each other in the paper width direction without positioning the photosensitive drum 28 and developing roller 38 relative to each other in the paper width direction.

(f) A plurality of inner rear walls 91 may be vertically erected from the receiving plate 90 forward of the lower rear wall 87.

(g) Further, at least one opening 115, instead of the plurality of the openings 115 in the above description, may be formed in the upper rear wall 95. Thus, the support plate 66 confronts the rear wall 95 with a space or gap being formed between the support plate 66 and the rear wall 95, and is in communication with the exterior of the casing via the at least one opening 115. At least a part of the support plate 66 confronts the at least one opening 115. The at least a part of the support plate 66 can be seen from outside the exterior of the drum casing 76.

(h) The cleaning member 32 or the opening 115 may not be provided in the drum casing 76.

(i) The positioning mechanism of positioning the developer casing 36 relative to the drum casing 76 and the positioning mechanism of positioning the drum casing 76 relative to the main frame 2 may not be limited to the above-described configurations.

What is claimed is:

1. A cartridge for use in an image-forming device, the cartridge comprising:

a casing having a wall that is formed with at least one opening that allows communication between an interior and an exterior of the casing;

an image-bearing member that is accommodated in the casing and that carries a developer image; and a cleaning unit that is accommodated in the casing and that confronts the wall with a space being formed between the cleaning unit and the wall, at least a part of the cleaning unit confronting the at least one opening, the at least a part of the cleaning unit being in communication with the exterior of the casing via the at least one opening, the cleaning unit being configured to remove matter deposited on the image-bearing member.

2. The cartridge as claimed in claim 1, wherein the cleaning unit comprises:

a fibrous cleaning member that is configured to contact the image-bearing member and capture matter deposited thereon; and a plate-shaped supporting member that faces the at least one opening and that supports the cleaning member on a side opposite the image-bearing member.

3. The cartridge as claimed in claim 2, wherein the cleaning unit extends in a longitudinal direction of the image-bearing member; and the supporting member has longitudinal ends, both of which ends are supported on the casing.

4. The cartridge as claimed in claim 3, wherein the supporting member has engagement parts provided one on each longitudinal end thereof; and the casing has engaging parts that engage the respective engagement parts.

5. The cartridge as claimed in claim 4, wherein the engagement parts are through-holes formed in the supporting member, and the engaging parts are pawl members provided in the casing.

6. The cartridge as claimed in claim 5, wherein each engagement part comprises a first engagement part and a second engagement part that are separated a prescribed distance in a direction orthogonal to the longitudinal direction;

each engaging part comprises a first engaging part that engages the first engagement part, and a second engaging part that engages the second engagement part; and the supporting member is supported, with the second engaging part being received in the second engagement part and the first engaging part being engaged on the first engagement part.

7. The cartridge as claimed in claim 2, further comprising a collecting portion disposed in the casing and configured to collect matter removed by the cleaning member;

wherein the supporting member is positioned to block communication between the at least one opening and the collecting part.

8. The cartridge as claimed in claim 2, wherein the supporting member has an electrical conductivity property, further comprising an electrode member that is provided separately from the supporting member, that urges the supporting member from a side opposite the cleaning member and that supplies a bias to the supporting member.

9. The cartridge as claimed in claim 2, further comprising a charging unit disposed in communication with the at least one opening, the charging unit charging the image-bearing member;

wherein the supporting member is disposed in a path of communication between the at least one opening and the charging unit.

10. The cartridge as claimed in claim 9, wherein the casing comprises support parts that supports the charging unit on a near side and a far side with respect to the at least one opening, the charging unit being interposed between the support parts;

the support parts comprise a first support part disposed on the far side of the charging unit with respect to the at least one opening and protruding inside the casing adjacent to the charging unit, and a second support part disposed on the near side of the charging unit with respect to the at least one opening and protruding inside the casing adjacent to the charging unit by a length shorter than the protruding length of the first support part.

11. The cartridge as claimed in claim 1, further comprising a heat-shielding wall disposed on the casing and preventing external hot air from contacting the cleaning unit.

12. The cartridge as claimed in claim 11, further comprising one or more additional heat-shielding wall disposed on the inner side of the casing relative to the heat-shielding wall.

13. The cartridge as claimed in claim 11, wherein the heat-shielding wall is disposed below the at least one opening when the cartridge is mounted in the image forming device.

14. The cartridge as claimed in claim 1, wherein the at least one opening is disposed above the cleaning unit when the cartridge is mounted in the image forming device.

15. The cartridge as claimed in claim 1, wherein the image bearing member is formed in a cylindrical shape, and rotatably supported around its rotational axis by the casing, further comprising a developer casing detachably mounted on the casing, wherein either one of the casing and the developer casing has a rib that is formed in a plate-shape and that extends in a direction orthogonal to the rotational axis of the image bearing member; and wherein the other of the casing and the developer casing has a positioning unit engaging with the rib to position the casing and the developer casing relative to each other in the direction parallel to the rotational axis of the image-bearing member.

16. The cartridge as claimed in claim 15, wherein the developer casing rotatably supports a developing roller, and is capable of accommodating a developer, wherein the image bearing member forms an electrostatic latent image thereon;

the developing roller is cylindrical in shape and is configured to carry the developer on a peripheral surface thereof to develop the electrostatic latent image into the developer image; and the developing roller is parallel to the image bearing member, and in confrontation with the same when the developer cartridge is mounted on the cartridge.

17. The cartridge as claimed in claim 16, wherein either one of the rib and the positioning unit that is formed on the developer casing is disposed in proximity of the rotational axis of the developing roller.

18. The cartridge as claimed in claim 16, wherein either one of the rib and the positioning unit that is formed on the developer casing is positioned outside a region of the developing roller that confronts an electrostatic latent image that is formed on the image-bearing member with respect to the longitudinal direction of the developing roller when the developer cartridge is mounted on the casing.

19. The cartridge as claimed in claim 18, further comprising a driving force transmission unit that transmits a rotational driving force to the developing roller;

wherein either one of the rib and the positioning unit that is formed on the developer casing is disposed in proximity of the driving force transmission unit.

20. An image-forming device comprising:

a main frame;

a cartridge detachably mounted in the main frame, the cartridge comprising:

a casing having a wall that is formed with at least one opening that allows communication between an interior and an exterior of the casing;

an image-bearing member that is accommodated in the casing and that carries a developer image; and a cleaning unit that is accommodated in the casing and that confronts the wall with a space being formed between the cleaning unit and the wall, at least a part of the cleaning unit confronting the at least one opening, the at least a part of the cleaning unit being in communication with the exterior of the casing via the at least one opening, the cleaning unit being configured to remove matter deposited on the image-bearing member;

a transfer unit that is mounted in the main frame and that transfers a developer image carried on the image-bearing member onto a recording medium; and a fixing unit that fixes the developer image to a recording medium.

21. The image-forming device as claimed in claim 20, wherein the fixing unit and the image-bearing member are separated from each other in a substantially horizontal direction when the cartridge is mounted in the main frame and when the main frame is disposed in an orientation in which it is intended to be used.

22. The image-forming device as claimed in claim 20, further comprising an exhausting unit that exhausts hot air that flows from the fixing unit toward the image-bearing member.

23. The image-forming device as claimed in claim 22, wherein the exhausting unit comprises:

a duct disposed above the at least one opening; and a fan exhausting air through the duct.

24. The image-forming device as claimed in claim 20, wherein the image bearing member forms an electrostatic latent image thereon, the image bearing member is formed in a cylindrical shape, and rotatably supported around the rotational axis by the casing, further comprising a developer casing detachably mounted on the casing and rotatably supporting a developing roller parallel to the image-bearing member and in confrontation with the same, the developing roller being cylindrical in shape and being configured to carry a developer on a peripheral surface thereof to develop the electrostatic latent image into the developer image, wherein: the main frame and the casing comprise a positioning mechanism that positions the casing relative to the main frame in a direction parallel to a rotational axis of the image-bearing member;

either one of the casing and the developer casing has a rib configured to position the casing and the developer casing relative to each other in a direction parallel to the rotational axis of the image-bearing member; and the other of the casing and the developer casing has a positioning unit that is configured to engage with the rib to position the casing and the developer casing relative to each other in a direction parallel to the rotational axis of the image-bearing member.

25. The image-forming device as claimed in claim 20, wherein either one of the rib and the engaging part formed on the casing is disposed in proximity of the positioning mechanism.

26. A method of fabricating a cartridge, the cartridge comprising: a casing having a wall that is formed with at least one opening that allows communication between an interior and an exterior of the casing; an image-bearing member that is accommodated in the casing and that carries a developer image; and a cleaning unit that is accommodated in the casing that confronts the wall with a space being formed between the cleaning unit and the wall, at least a part of the cleaning unit confronting at least a part of the at least opening, the at least a part of the cleaning unit being in communication with the exterior of the casing via the at least a part of the opening, the cleaning unit being configured to remove matter deposited on the image-bearing member, and extending in a longitudinal direction of the image-bearing member, the cleaning unit comprising: a fibrous cleaning member that is configured to contact the image-bearing member and capture matter deposited thereon; and a plate-shaped supporting member that faces the at least a part of the at least one opening and that supports the cleaning member on a side opposite the image-bearing member, the supporting member having longitudinal ends, both of which ends are supported on the casing, the supporting member having engagement parts provided one on each longitudinal end thereof; wherein the casing has engaging parts that engage the respective engagement parts; wherein the engagement parts are through-holes formed in the supporting member, and the engaging parts are pawl members provided in the casing; wherein each engagement part comprises a first engagement part and a second engagement part that are separated a prescribed distance in a direction orthogonal to the longitudinal direction; and wherein each engaging part comprises a first engaging part that engages the first engagement part, and a second engaging part that engages the second engagement part, the method comprising:

engaging the second engagement parts with the second engaging parts;

rotating, after engaging the second engagement parts with the second engaging parts, the supporting plate around the its position where the second engagement parts are engaged with the second engaging parts; and engaging the first engagement parts with the first engaging parts after rotating the supporting plate.

27. An image-bearing cartridge for use in an image-forming device, the image-bearing cartridge comprising:

a casing having a wall that is formed with at least one opening that allows communication between an interior and an exterior of the casing;

an image-bearing member that is accommodated in the casing and that carries a developer image; and a cleaning unit that is accommodated in the casing and that confronts the wall with a space being formed between the cleaning unit and the wall, at least a part of the cleaning unit confronting at least a part of the at least one opening, the at least a part of the cleaning unit being in communication with the exterior of the casing via the at least one opening, the cleaning unit being configured to remove matter deposited on the image-bearing member.

28. A process cartridge for use in an image-forming device, the process cartridge comprising:

a drum casing accommodates a photosensitive drum that carries a developer image, the photosensitive drum being formed in a cylindrical shape, and rotatably supported around its rotational axis by the drum casing, a developer casing detachably mounted on the drum casing, wherein either one of the drum casing and the developer casing has a rib that is formed in a plate-shape and that extends in a direction orthogonal to the rotational axis of the photosensitive drum; and wherein the other of the drum casing and the developer casing has a positioning unit engaging with the rib to position the drum casing and the developer casing relative to each other in the direction parallel to the rotational axis of the photosensitive drum.

29. The process cartridge as claimed in claim 28, wherein the developer casing rotatably supports a developing roller, and is capable of accommodating a developer, wherein the photosensitive drum forms an electrostatic latent image thereon;

the developing roller is cylindrical in shape and is configured to carry the developer on a peripheral surface thereof to develop the electrostatic latent image into the developer image; and the developing roller is parallel to the photosensitive drum, and in confrontation with the same when the developer cartridge is mounted on the process cartridge.

30. The process cartridge as claimed in claim 29, wherein either one of the rib and the positioning unit that is formed on the developer casing is disposed in proximity of the rotational axis of the developing roller.

31. The process cartridge as claimed in claim 29, wherein either one of the rib and the positioning unit that is formed on the developer casing is positioned outside a region of the developing roller that confronts an electrostatic latent image that is formed on the photosensitive drum with respect to the longitudinal direction of the developing roller when the developer cartridge is mounted on the drum casing.

32. The process cartridge as claimed in claim 31, further comprising a driving force transmission unit that transmits a rotational driving force to the developing roller;

wherein either one of the rib and the positioning unit that is formed on the developer casing is disposed in proximity of the driving force transmission unit.

33. An image-forming device comprising:

a main frame;

a process cartridge detachably mounted in the main frame, the process cartridge comprising a drum casing that accommodates a photosensitive drum, the photosensitive drum carrying an electrostatic latent image thereon, being formed in a cylindrical shape, rotatably supported around its rotational axis by the drum casing, and forming an electrostatic latent image thereon; and a developer casing detachably mounted on the drum casing and rotatably supporting a developing roller parallel to the photosensitive drum and in confrontation with the same, the developing roller being cylindrical in shape and being configured to carry a developer on a peripheral surface thereof to develop the electrostatic latent image into a developer image, wherein the main frame and the drum casing comprise a positioning mechanism that positions the drum casing relative to the main frame in a direction parallel to the rotational axis of the photosensitive drum;

either one of the drum casing and the developer casing has a rib configured to position the drum casing and the developer casing relative to each other in a direction parallel to the rotational axis of the photosensitive drum; and the other of the drum casing and the developer casing has a positioning unit that is configured to engage with the rib to position the drum casing and the developer casing relative to each other in a direction parallel to the rotational axis of the photosensitive drum.

34. The image-forming device as claimed in claim 33, wherein either one of the rib and the engaging part formed on the drum casing is disposed in proximity of the positioning mechanism.

* * * * *